US010287071B2

(12) United States Patent
Bartkow

(10) Patent No.: US 10,287,071 B2
(45) Date of Patent: May 14, 2019

(54) APPARATUS AND METHOD FOR DRINKING CONTAINER COVER

(71) Applicant: Bruce Bartkow, West Hollywood, CA (US)

(72) Inventor: Bruce Bartkow, West Hollywood, CA (US)

( * ) Notice: Subject to any disclaimer, the term of this patent is extended or adjusted under 35 U.S.C. 154(b) by 435 days.

(21) Appl. No.: 15/018,776

(22) Filed: Feb. 8, 2016

(65) Prior Publication Data

US 2016/0152388 A1 Jun. 2, 2016

Related U.S. Application Data

(63) Continuation-in-part of application No. 13/354,230, filed on Jan. 19, 2012.

(60) Provisional application No. 61/435,081, filed on Jan. 21, 2011.

(51) Int. Cl.
*B65D 65/02* (2006.01)
*B65D 65/24* (2006.01)
*B65B 7/28* (2006.01)

(52) U.S. Cl.
CPC ..... *B65D 65/02* (2013.01); *B65B 7/28* (2013.01); *B65D 65/24* (2013.01)

(58) Field of Classification Search
CPC ..... B65D 41/14; B65D 41/22; B65D 41/24; B65D 41/44; B65D 41/48; B65D 65/02; B65D 65/06; B65D 65/10; B65D 65/12; B65D 65/24; B65D 43/0222; B65D 65/04
USPC ..... 220/287, 796; 229/404, 125.06, 906.1; 215/246, 326
See application file for complete search history.

(56) References Cited

U.S. PATENT DOCUMENTS

| | | | | |
|---|---|---|---|---|
| 919,937 A | | 4/1909 | Olsson | |
| 2,074,325 A | | 3/1937 | Carew | |
| 2,271,253 A | | 1/1942 | Conway, Jr. | |
| 2,298,480 A | | 10/1942 | Harvey | |
| 2,355,493 A | * | 8/1944 | Wilcox | B65D 41/14 215/326 |
| 2,689,664 A | | 9/1954 | Vingron | |

(Continued)

OTHER PUBLICATIONS

Clark-Flory, Tracy, "A protective cover for your cocktail: The new defense against date-rape drugs. Ingenious or just plain dumb?" http://www.salon.com/life/broadsheet/2007/06/21/date_rape, Jun. 21, 2007.

(Continued)

*Primary Examiner* — Robert Poon
(74) *Attorney, Agent, or Firm* — Kregg A. Koch

(57) ABSTRACT

Embodiments disclosed herein relate to a cover for protecting the contents of a drinking container from unwanted contamination. The cover can have a middle portion and a first flap and a second flap extending away from the middle portion. The first flap can be rotatable relative to the middle portion from a first position in which the first flap is generally parallel with and adjacent to the middle portion to a second position in which the first flap extends at an angle away from the middle portion. In some embodiments, when the first flap is rotated to the second position, the first flap can surround at least a portion of an outside surface of the drinking container adjacent to the opening so as to secure the cover to the drinking container to cover the opening of the drinking container.

21 Claims, 22 Drawing Sheets

(56) References Cited

U.S. PATENT DOCUMENTS

| | | | | |
|---|---|---|---|---|
| 3,057,537 | A | 10/1962 | Pollick | |
| 3,360,132 | A | 12/1967 | Miller, II | |
| 3,655,089 | A | 4/1972 | Tower | |
| 3,874,554 | A | 4/1975 | Chang | |
| 4,036,392 | A | 7/1977 | Martin | |
| 4,095,710 | A | 6/1978 | Tomiati | |
| 4,221,670 | A | 9/1980 | Ziemek | |
| 4,246,717 | A | 1/1981 | Wachtel | |
| 4,247,016 | A | 1/1981 | Shaw | |
| 4,407,429 | A | 10/1983 | Hekal | |
| 4,615,457 | A | 10/1986 | Harding | |
| 4,708,257 | A | 11/1987 | Deline | |
| 4,830,204 | A | 5/1989 | Lin | |
| 4,934,558 | A * | 6/1990 | Vargas | B65D 51/00 220/287 |
| 5,018,635 | A | 5/1991 | Whittaker | |
| 5,054,640 | A | 10/1991 | Tucker | |
| 5,071,019 | A | 12/1991 | Sizemore | |
| 5,088,614 | A | 2/1992 | Dumestre | |
| 5,203,467 | A | 4/1993 | Tucker | |
| 5,617,970 | A | 4/1997 | Lee | |
| 5,727,734 | A | 3/1998 | Su | |
| 5,791,510 | A | 8/1998 | Paczonay | |
| 5,819,972 | A | 10/1998 | Puente Pubill | |
| 5,823,422 | A | 10/1998 | Collier | |
| 5,984,135 | A | 11/1999 | Brown | |
| 6,502,693 | B1 | 1/2003 | Percival | |
| 6,557,484 | B1 | 5/2003 | Engelman | |
| 7,222,746 | B2 | 5/2007 | Eckstrum | |
| 7,299,941 | B2 | 11/2007 | McMahon, III | |
| 7,318,534 | B2 | 1/2008 | Turvey | |
| 8,251,239 | B2 * | 8/2012 | Yeung | A47G 19/26 220/240 |
| 2004/0251256 | A1 * | 12/2004 | Turvey | B65D 25/16 220/287 |
| 2006/0289548 | A1 | 12/2006 | Schatz | |
| 2007/0178284 | A1 | 8/2007 | Barry | |
| 2008/0035665 | A1 | 2/2008 | Edmunds | |
| 2008/0217347 | A1 | 9/2008 | Markaj | |

OTHER PUBLICATIONS

U.S. Appl. No. 13/354,230, filed Jan. 19, 2016.

* cited by examiner

APPARATUS AND METHOD FOR DRINKING CONTAINER COVER

PRIORITY CLAIM

This application is a continuation in part of U.S. patent application Ser. No. 13/354,230, filed Jan. 19, 2012 (titled "Drinking Container Cover Apparatus"), which claims priority to U.S. Provisional Application 61/435,081, filed Jan. 21, 2011. Each of the two above-listed applications are hereby incorporated by reference as if fully set forth herein. The benefit of priority is claimed under the appropriate legal basis including, without limitation, under 35 U.S.C. § 119 (e).

BACKGROUND OF THE DISCLOSURE

Technical Field

The embodiments of the present disclosure relate to protective covers for beverage containers, more particularly, to disposable, protective covers that can be applied over the rim of a glass to cover the opening of a glass.

SUMMARY OF SOME EXEMPLIFYING EMBODIMENTS

Some of the disposable, protective drink covers disclosed herein are configured to provide a protective cover to glasses, cups, bottles, and other beverage containers or other containers (collectively referred to throughout this disclosure as "glass" or "glasses", whether or not the container is made out of glass, plastic, metal, or other material), to protect the contents of the glass from outside contamination. Such covers can prevent inadvertent or unwanted contamination of the contents of the glass. The contaminant can be drugs, dirt, insects, or other unwanted objects. Providing such protective covers from outside contamination can lessen liability to servers or providers of beverages within, for example and without limitation, the hospitality service industry, more specifically, bars, clubs and lounges. Any embodiments of the protective drink cover disclosed herein can be sized and configured to fit all service industry glassware and drinkware used today. With the protective cover, all users can protect their beverage while freely enjoying the nightlife (dancing, shooting pool, throwing darts, swimming, etc.), without concern for contamination of their beverage.

In an example embodiment, with one light press by a user, the cup cover can mold around the rim of the glass, securing the contents of the glass from unwanted contaminants, thereby giving the user security from worry. Other embodiments may need more than one light press to conform the cup cover to the glass. In any embodiments disclosed herein, a precut straw perforation can be formed in the cup cover to allow a straw to be easily passed through the cup cover.

Some embodiments disclosed herein relate to a cover for protecting the contents of a drinking container from unwanted contamination. The cover can have a first surface and a second surface opposing the first surface and a plurality of approximately concentrically arranged circular shaped markings or indentations formed in the first surface, or perforations formed through the first surface and extending to the second surface. Any embodiments of the cover disclosed herein can alternatively or additionally have a plurality of outward markings formed in the first surface, or outward perforations extending generally from a middle portion of the cover toward a peripheral edge of the cover.

The outward perforations can comprise one or more perforated lines or curves formed through the first surface and extending to the second surface. The cover can have any suitable shape, including an approximately circular shape.

Some embodiments disclosed herein relate to a cup cover for protecting the contents of a glass, comprising a first surface and a second surface opposing the first surface and a plurality of circular shaped perforations formed through at least the first surface. In some arrangements, the circular shaped perforations can be approximately concentrically arranged. Additionally, the circular shaped perforations can be configured to facilitate the folding of the cup cover over the rim of a glass.

Some embodiments disclosed herein relate to a method of protecting a glass from outside contamination, comprising positioning a cup cover over the rim of a glass such that a circular shaped perforation is approximately aligned with the rim of the glass; and folding the cup cover over the rim of the glass such that a peripheral portion of the cup cover is in contact with the sides of the glass.

Some embodiments disclosed herein are directed to a cover for protecting the contents of a drinking container from unwanted contamination, comprising a cover member. In any arrangements or embodiments disclosed herein, the cover member can have a first surface and a second surface opposing the first surface, a middle portion and a peripheral edge, the peripheral edge defining an outer boundary of the cover member, a plurality of approximately concentrically arranged circular shaped indentations formed through the first surface and extending toward the second surface, and a plurality of preformed creases formed in the cover member extending outwardly from the middle portion of the cover member toward the peripheral edge of the cover member. The plurality of preformed creases can be configured to assist in a wrapping of at least a peripheral portion of the cover member around a side wall portion of the drinking container.

In any arrangements or embodiments disclosed herein, the circular shaped indentations can be configured to facilitate folding of the cover member over a rim of a glass. Additionally, in any arrangements or embodiments disclosed herein, the substrate of the cover member can be from entirely from paper, can be formed mostly from paper, or can comprise paper. For example, without limitation, any embodiments or arrangements of the cover or cover member disclosed herein can have a paper substrate extending from the center of the cover member to the peripheral edge of the cover member.

In any arrangements or embodiments disclosed herein, the cover member can be moveable between a first state in which the cover member is substantially planar and a second state in which at least the peripheral portion of the cover member is wrapped around the side wall portion of the drinking container. For example, the cover member can be used as a coaster placed under the drinking container when the cover member is in the first configuration.

Any arrangements or embodiments of the cover or cover member disclosed herein can have a first group of creases formed during manufacturing operations in a first portion of the cover member and a second group of creases formed during manufacturing operations in a second portion of the cover member, wherein the second location is different than the first location. The first group of creases can have a plurality of curved and/or linear creases. The second group of creases can have a plurality of curved and/or linear creases. And, the plurality of curved and/or linear creases of the first group of creases can have the same shape and arrangement as the plurality of curved and/or linear creases of the second group of creases. Additionally, in any embodiments disclosed herein, the cup cover or cover member can have three or more approximately concentrically arranged circular shaped indentations. Any embodiments of the cup cover disclosed herein can also have a plurality of circular shaped markings formed on the first surface, the plurality of circular shaped markings being approximately aligned with the plurality of circular shaped indentations.

Some embodiments disclosed herein are directed to a cup cover for protecting the contents of a glass, comprising a cover element, wherein the cover element can have a first surface and a second surface opposing the first surface, a plurality of circular shaped indentations formed in at least the first surface, and one or more creases extending generally from a middle portion of the cover element toward at least one peripheral edge of the cover element. The at least one peripheral edge can define an outer boundary of the cover element.

In any embodiments disclosed herein, the circular shaped indentations can be approximately concentrically arranged. The circular shaped indentations can be configured to facilitate folding of the cup cover at the location of the indentations over a rim of a glass. As mentioned above, in any embodiments disclosed herein, the cover element can be formed from paper from the middle portion of the cover element extending to the at least one peripheral edge of the cover element. Any embodiments of the cover element disclosed herein can be configured to be moveable between a first state in which the cover element is substantially planar and a second state in which at least the peripheral edge of the cover element is wrapped around the side wall portion of the drinking container. The cup cover can have three or more approximately concentrically arranged circular shaped indentations.

Any embodiment of the cup cover can comprise a plurality of circular shaped markings formed on the first surface of the cover element. The plurality of circular shaped markings can be approximately aligned with the plurality of circular shaped indentations. Additionally, any of the embodiments of the cup cover or cover member disclosed herein can have one or more slits formed through at least the first surface of the cover element or cover member. Though not required, the one or more slits can be positioned in a middle portion of the cover element and being sized to allow a drinking straw to pass therethrough.

Any of the cup members or elements disclosed herein can have a first group of curved and/or linear creases and/or perforations formed at a first location of the cover element and a second group of curved and/or linear creases and/or perforations formed at a second location of the cover element, wherein the second location is at a circumferentially different position than the first location. The curved and/or linear creases and/or perforations of the first group can have the approximately same shape and arrangement as the curved and/or linear creases and/or perforations of the second group.

Additionally, though not required, any of the cover member or cover embodiments disclosed herein can have additional features and substances to increase the adherence or cling of the cover member to the drinking container. For example and without limitation, any embodiments disclosed herein can have a coating of adhesive on a second or inside surface of the cover element configured to removable adhere to an outside surface of the drinking container. The adhesive can be water soluble and easily washed away from the drinking container after use.

Any of the cup cover or cover member embodiments disclosed herein can have text, printing, or other markings of any kind formed on the cup cover or cover member. This can include, for example and without limitation, instructions on how to use the cover member, advertising or promotional messaging, markings to assist a user on where to position a user's fingers or hand on the cover member during use, and/or markings to assist a user on where to position the cover member relative to the drinking container during usage.

Some arrangements or embodiments disclosed herein are directed to a method of protecting a glass from outside contamination, comprising positioning any embodiment of the cup cover or cover member over a rim of a glass such that one of the circular shaped indentations is approximately aligned with the rim of the glass, and folding the cup cover over the rim of the glass such that a peripheral portion of the cup cover is in contact with the sides of the glass. Folding the cup cover over the rim of the glass such that a peripheral portion of the cup cover is in contact with the sides of the glass can comprise folding the cup cover along outward indentations extending from a middle portion of the cover member toward a peripheral edge of the cover member. The outward indentations can be, but are not required to be, approximately linear.

Any embodiments disclosed herein can have one or a plurality of straight creases each extending in a radial direction from the middle portion of the cover member to the peripheral edge of the cover member. At least a portion of the middle portion of the cover member can be generally flat. Any of the cup cover or cover member embodiments disclosed herein can have an approximately square shape. Additionally, any of the cup cover or cover member embodiments disclosed herein can be configured to be used interchangeably as a drinking container cover and as a coaster for positioning under the drinking container.

Some embodiments are directed to a cup cover for protecting the contents of a glass, comprising a cover element that can have a first surface and a second surface opposing the first surface, a first circular shaped indentation formed in at least the first surface, the first circular shaped indentation having a size that is approximately the same as a size of a rim of a glass that the cup cover is collapsible over, a second circular shaped indentation formed in at least the first surface, the second circular shaped indentation being approximately concentric with the first circular shaped indentation and concentric to the first circular shaped indentation, and one or more creases extending from at least the first circular shaped indentation toward at least one peripheral edge of the cover element. The circular shaped indentations can be configured to facilitate the collapsing of the cup cover at the location of the indentations over the rim of the glass. The cover element can be configured to be moveable between a first state in which the cover element is substantially planar and a second state in which at least the peripheral edge of the cover element is wrapped around the side wall portion of the drinking container.

Some embodiments can be directed to one or more of the following arrangements, or any combinations there.

Arrangement 1: A cover for protecting the contents of a drinking container from unwanted contamination, comprising:

- a main body portion having a first surface and a second surface, the second surface opposing the first surface;
- a first flap portion coupled with the main body portion; and a second flap portion coupled with the main body portion; wherein:

the main body portion has an outer perimeter that is at least as big as an outer perimeter of a rim of the drinking container;

the first flap portion is coupled with the main body portion such that the first flap portion is movable relative to the main body portion from a first position in which the first flap portion is generally parallel with and adjacent to the second surface of the main body portion to a second position in which the first flap portion extends at an angle away from the second surface of the main body portion;

the second flap portion is coupled with the main body portion such that the second flap portion is movable relative to the main body portion from a first position in which the second flap portion is generally parallel with and adjacent to the second surface of the main body portion to a second position in which the second flap portion extends at an angle away from the second surface of the main body portion; and when the first and second flap portions are both moved to the second position, the first and second flap portions are configured to surround at least a portion of an outside surface of the drinking container adjacent to the opening so as to secure the cover to the drinking container to cover the opening of the drinking container.

The cover of Arrangement 1, wherein the cover member is configured such that moving the first flap portion from the first position to the second position will cause a ridge to be formed in the first flap portion.

The cover of any one of the foregoing Arrangements, wherein the cover member is configured such that moving the second flap portion from the first position to the second position will cause a ridge to be formed in the second flap portion.

The cover of any one of the foregoing Arrangements, wherein the cover member is configured such that moving the first flap portion from the first position to the second position will cause the first flap portion to be changed from a planar state to a corrugated state.

The cover of any one of the foregoing Arrangements, wherein the main body portion, the first flap portion, and the second flap portion are each made entirely from one or more substantially non-stretchable materials.

The cover of any one of the foregoing Arrangements, wherein the cover is configured to move from the first state to the second state and from the second state to the first state without substantially stretching any portion of the cover.

The cover of any one of the foregoing Arrangements, wherein, when the first and second flap portions are in the second position, the cover is positionable over an opening of the glass such that the first flap portion and the second flap portion at least partially surround an outside surface of the glass adjacent to a rim of the glass and the main body portion of the cover completely covers the opening of the glass.

The cover of any one of the foregoing Arrangements, wherein when the first and second flaps are in the first position, the cover is generally planar.

The cover of any one of the foregoing Arrangements, wherein the main body portion has a first crease extending entirely across the main body portion along a centerline of the main body portion, the main body portion being foldable and bendable about the first crease of the main body portion.

The cover of any one of the foregoing Arrangements, wherein the first flap portion has a first crease along at least a portion thereof, the first flap portion being foldable and bendable about the first crease of the first flap portion.

The cover of any one of the foregoing Arrangements, wherein the second flap portion has a first crease along at least a portion thereof, the second flap portion being foldable and bendable about the first crease of the second flap portion.

The cover of any one of the foregoing Arrangements, wherein the main body portion has a first bend line extending entirely across the main body portion along a centerline of the main body portion, the main body portion being foldable and bendable about the first bend line of the main body portion, wherein the bend line can have at least one of perforations.

The cover of any one of the foregoing Arrangements, wherein the first flap portion has a first bend line along at least a portion thereof, the first flap portion being foldable and bendable about the first bend line of the first flap portion.

The cover of the previous Arrangement, wherein the second flap portion has a first bend line along at least a portion thereof, the second flap portion being foldable and bendable about the first bend line of the second flap portion.

The cover of any one of the foregoing Arrangements, wherein:

the first flap portion has a first bend line along at least a portion thereof and a second bend line along at least a portion thereof;

the first bend line and the second bend line are separated by an angle between approximately 80° and approximately 110°; and the first flap portion is foldable and bendable simultaneously about the first and second bend lines.

The cover of any one of the foregoing Arrangements, wherein the main body portion, the first flap portion, and the second flap portion are formed monolithically.

The cover of any one of the foregoing Arrangements, wherein at least a portion of the first flap portion and a portion of the second flap portion are coupled with a portion of the second surface of the main body portion.

The cover of any one of the foregoing Arrangements, wherein at least a portion of the first flap portion and a portion of the second flap portion are coupled with the second surface of the main body portion using at least one of adhesive, staples, stitiching, or other fasteners.

The cover of any one of the foregoing Arrangements, wherein the first flap portion and the second flap portion each covers approximately 45% of the main body portion when the first flap portion portions and the second flap portion portions are in the first state.

The cover of any one of the foregoing Arrangements, comprising preformed folds or creases formed in at least one of the main body, the first flap portion, and the second flap portion to facilitate folding or bending of the cover along the creases, the creases being formed as part of a manufacturing process for the cover.

The cover of any one of the foregoing Arrangements, having only two flaps consisting of the first flap portion and the second flap portion.

The cover of any one of the foregoing Arrangements, wherein an outer periphery of the cover has an approximately square shape.

The cover of any one of the foregoing Arrangements, wherein an outer periphery of the cover has an approximately circular shape.

Arrangement 24: A cover for a drinking container, comprising:

a middle portion having a first surface and a second surface, the second surface opposing the first surface; and a first flap extending away from the second surface of the middle portion; wherein:

the middle portion has an outer perimeter that is at least as big as an outer perimeter of a rim of the drinking container;

the first flap is rotatable relative to the second surface of the middle portion from a first position in which the first flap is generally parallel with and adjacent to the second surface of the middle portion to a second position in which the first flap extends at an angle away from the second surface of the middle portion; and when the first flap is rotated to the second position, the first flap is configured to surround at least a portion of an outside surface of the drinking container adjacent to the opening so as to secure the cover to the drinking container to cover the opening of the drinking container.

The cover of Arrangement 24, wherein the cover member further comprises a second flap extending away from the second surface of the middle portion, wherein:

the second flap is rotatable relative to the second surface of the middle portion from a first position in which the second flap is generally parallel with and adjacent to the second surface of the middle portion to a second position in which the second flap extends at an angle away from the second surface of the middle portion; and when the second flap is rotated to the second position, the second flap is configured to surround at least a portion of an outside surface of the drinking container adjacent to the opening so as to secure the cover to the drinking container to cover the opening of the drinking container.

The cover of any one of the foregoing Arrangements, wherein the cover member is configured such that moving the first flap from the first position to the second position will cause a ridge to be formed in the first flap.

The cover of the foregoing Arrangement, wherein the cover member is configured such that moving the second flap from the first position to the second position will cause a ridge to be formed in the second flap.

The cover of any one of the foregoing Arrangements, wherein the cover member is configured such that moving the first flap from the first position to the second position will cause the first flap to be changed from a planar state to a corrugated state.

The cover of any one of the foregoing Arrangements, wherein the middle portion, the first flap, and the second flap are each made entirely from one or more substantially non-stretchable materials.

The cover of any one of the foregoing Arrangements, wherein the cover is configured to move from the first state to the second state and from the second state to the first state without substantially stretching any portion of the cover.

The cover of any one of the foregoing Arrangements, wherein the cover is configured to at least substantially cover the opening of the drinking container without substantially stretching any portion of the cover.

The cover of any one of the foregoing Arrangements, wherein, when the first and second flaps are in the second position, the cover is positionable over an opening of the glass such that the first flap and the second flap at least partially surround an outside surface of the glass adjacent to a rim of the glass and the middle portion of the cover completely covers the opening of the glass.

The cover of any one of the foregoing Arrangements, wherein when the first and second flaps are in the first position, the cover is generally planar.

The cover of any one of the foregoing Arrangements, wherein the middle portion has a first crease extending entirely across the middle portion along a centerline of the middle portion, the middle portion being foldable and bendable about the first crease of the middle portion.

The cover of any one of the foregoing Arrangements, wherein the first flap has a first crease along at least a portion thereof, the first flap being foldable and bendable about the first crease of the first flap.

The cover of any one of the foregoing Arrangements, wherein the cover has a second flap extending away from the second surface of the middle portion, and the second flap has a first crease along at least a portion thereof, the second flap being foldable and bendable about the first crease of the second flap.

The cover of the foregoing Arrangement, wherein the first flap and the second flap each covers approximately 45% of the middle portion when the first flap portions and the second flap portions are in the first state.

The cover of any one of the foregoing Arrangements, wherein the middle portion has a first bend line extending entirely across the middle portion along a centerline of the middle portion, the middle portion being foldable and bendable about the first bend line of the middle portion, wherein the bend line can have at least one of perforations.

The cover of any one of the foregoing Arrangements, wherein the first flap has a first bend line along at least a portion thereof, the first flap being foldable and bendable about the first bend line of the first flap.

The cover of any one of the foregoing Arrangements, wherein the cover has a second flap extending away from the second surface of the middle portion, and, wherein the second flap has a first bend line along at least a portion thereof, the second flap being foldable and bendable about the first bend line of the second flap.

The cover of any one of the foregoing Arrangements, wherein:

the first flap has a first bend line along at least a portion thereof and a second bend line along at least a portion thereof;

the first bend line and the second bend line are separated by an angle between approximately 80° and approximately 110°; and the first flap is foldable and bendable simultaneously about the first and second bend lines.

The cover of any one of the foregoing Arrangements, wherein the middle portion and the first flap are formed monolithically.

The cover of any one of the foregoing Arrangements, wherein at least a portion of the first flap is coupled with a portion of the second surface of the middle portion.

The cover of any one of the foregoing Arrangements, wherein at least a portion of the first flap is coupled with the second surface of the middle portion using at least one of adhesive, staples, stitiching, or other fasteners.

The cover of any one of the foregoing Arrangements, comprising preformed folds or creases formed in at least one of the main body, the first flap, and the second flap to facilitate folding or bending of the cover along the creases, the creases being formed as part of a manufacturing process for the cover.

The cover of any one of the foregoing Arrangements, having only two flaps consisting of the first flap and the second flap.

The cover of any one of the foregoing Arrangements, wherein an outer periphery of the cover has an approximately square shape.

The cover of any one of the foregoing Arrangements, wherein an outer periphery of the cover has an approximately circular shape.

Arrangement 49: A method of protecting a glass from outside contamination by covering an opening of the glass with a cover member, comprising:

moving a first flap from a first position in which the first flap is adjacent to a main body portion of the cover member to a second position in which the first flap extends away from the main body portion of the cover member;

moving a second flap from a first position in which the second flap is adjacent to a main body portion of the cover member to a second position in which the second flap extends away from the main body portion of the cover member; and positioning the cover member over the rim of the glass.

The method of protecting a glass from outside contamination of Arrangement 49, wherein moving the first flap from the first position to the second position and moving the second flap from the first position to the second position comprises squeezing the sides of the cover member to cause the first and second flaps to bend away from the main body portion of the cover member.

BRIEF DESCRIPTION OF THE DRAWINGS

These and other features, aspects and advantages of this disclosure will now be described in connection with some embodiments of the present disclosure, in reference to the accompanying drawings. The illustrated embodiments, however, are merely examples and are not intended to limit the present disclosure. The following are brief descriptions of the drawings.

DETAILED DESCRIPTION OF SOME EXEMPLIFYING EMBODIMENTS

The following detailed description is now directed to certain specific embodiments of the present disclosure. In this description, reference is made to the drawings wherein like parts are designated with like numerals throughout the description and the drawings.

Figure 1:
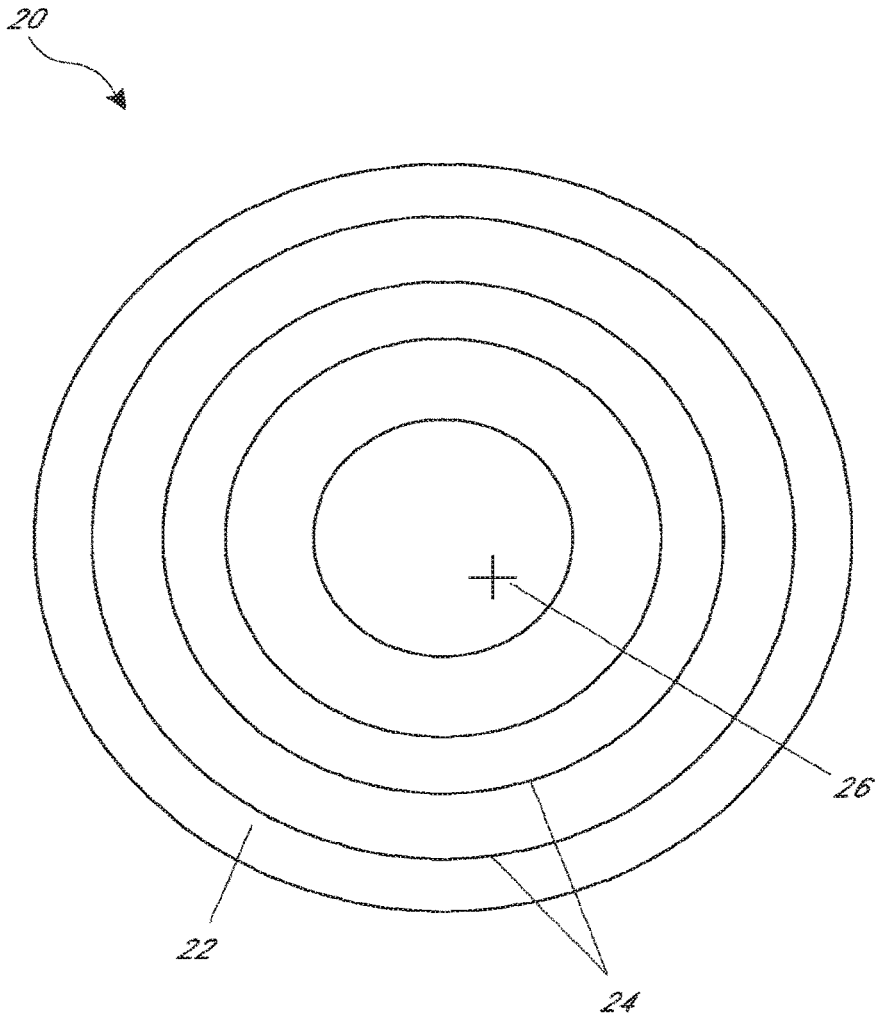
FIG. 1 is a top view of an embodiment of a cup cover of the present disclosure, showing an arrangement of approximately concentrically positioned circles marked on at least a top surface of the cup cover.

FIG. 1 is a top view of an embodiment of a cup cover 20 of the present disclosure. As will be described in greater detail, the cup cover 20 can be positioned over the opening of a glass to protect the contents of the glass from unwanted contamination. With reference to FIG. 1, the cup cover 20 can have an arrangement of approximately concentrically positioned rings or circles 24 marked on at least a top surface 22 of the cup cover 20. As with any of the embodiments disclosed herein, the concentrically positioned rings or circles 24 can each be sized to approximately correspond to the size or diameter of a variety of beverage glass diameters. As used throughout this disclosure, where appropriate, the term approximately is meant to refer to a range within approximately plus or minus 10% of the described diameter or size. For example but without limitation, for the approximately concentric circles 24, the center of the plurality of circles can all be within a circle that is 10% or less of the diameter or size of the cover 20.

Exemplifying beverage glasses that can be covered with any embodiment of the protective cover disclosed herein can include, without limitation, red or white wine glasses, champagne glasses, pint glasses, margarita glasses, tumblers, martini glasses, beer, soda, or other beverage cans, and bottles. Such sizes can be printed on any embodiments of the covers disclosed herein. Further, the size or diameter of the approximately concentrically positioned rings can correspond to the size or diameter of any of the aforementioned beverage glass or container diameters. The rings can be configured to assist a user in aligning the cup cover over the rim of the glass such that the center or middle portion of the cover is approximately aligned with the center or middle portion of the glass. In any embodiments disclosed herein, the circles or rings can comprise markings, slits, and/or indentations in the top surface of the cover and/or perforations through the cover.

Figure 2:
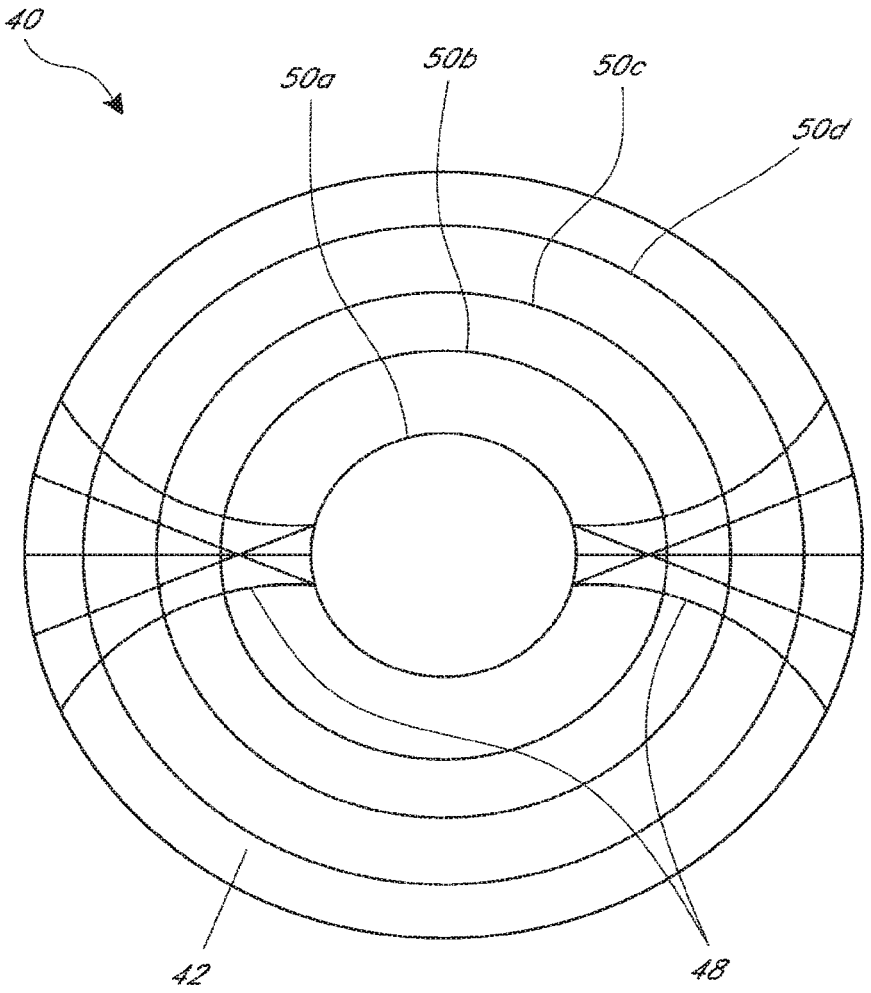
FIG. 2 is a top view of an embodiment of a cup cover, showing an arrangement of curved perforations formed through at least a portion of the thickness of the cover.

FIG. 2 is a top view of an embodiment of a cup cover 40, showing an arrangement of curved perforations 48 formed through at least a portion of the thickness of the cover 40 into the top surface 42 (also referred to as a first surface) of the cover 40. In any of the cover embodiments disclosed herein, any number of the perforations 48 can be curved, linear, approximately linear, or otherwise (collectively referred to herein as outward perforations or outward markings). The outward perforations or markings can cause the cover 40 to collapse about the glass to thereby conform to the glass tightly, securely, and easily.

In any embodiments disclosed herein, the outward perforations (for example, perforations 48) can extend from a middle portion of the cover (for example but without limitation, from the region indicated by the innermost marking or circular perforation 50*a*) to an outer peripheral edge of the cover 40. The outward perforations 48 can extend at least through the first surface 42 of the cover 40. In any embodiments disclosed herein, the perforations can extend from the first surface 42 of the cover 40 (or any cover described herein) through the second, opposite surface of the cover.

Additionally, the cover 40 can have a plurality of perforated or marked rings 50 approximately concentrically arranged on the cover 40. For example, a first ring 50*a* can have a diameter that is approximately equivalent to a diameter of a champagne glass. In this configuration, a user may position a champagne glass against the bottom surface of the cover 40 and align a rim of the champagne glass with ring 50*a* so that a user positioning the cover 40 over a champagne glass can cause the cover 40 to collapse about the glass tightly, securely, and easily.

Similarly, the cover 40 can have a second ring 50*b* that can be concentric to the first ring 50*a*, the second ring 50*b* having a diameter suitable for use with, for example and without limitation, a pint glass, rocks glass, or a wine glass. Further, the cover 40 can have a third ring 50*c* that can be concentric to the first ring 50*a*, the third ring 50*c* having a diameter suitable for use with, for example and without limitation, a martini glass. Some embodiments of the cover 40 can have a fourth ring 50*c* that can be concentric to the first ring 50*a*, the fourth ring 50*d* having a diameter suitable for use with, for example and without limitation, a margarita glass.

Any number of rings can be positioned on or formed in the cover 40, or any cover embodiment disclosed herein, for any sized glass. Additionally, the foregoing rings can comprise markings, perforations, creases, indentations, or other similar features and can be formed in any embodiments disclosed herein. The outward perforations or perforation design 48 can allow for a foldable, fitted cover to be formed around the rim of glass, in the varying sizes represented by the circular perforated rings 50 on the embodiment of the cup cover 40 illustrated therein. These specific perforations, which may be described as the "clam-shell" design, can grip around the rim of the glass, creating a more securely affixed preventative cup cover 40. The circular perforations can assist the user in initiating the folding of the cover over the rim of the desired glass. The outward and circular perforations can also assist the user in tightly wrapping the peripheral portions of the cover around the side walls of the glass, adjacent to the rim.

In any of the embodiments disclosed herein, the circular, linear, or curved perforations (for example and without limitation, the perforations 48, 50) can extend through the entire thickness of the cover, i.e., from the first surface through to the opposite second surface. In any of the cover embodiments disclosed herein, the cover can have any combination of markings, perforations, creases, indentations, or other similar features in place of some or all of the outward perforations extending from a middle portion of the cover to the outside surface of the cover (for example and without limitation, in place of any of the perforations 48 shown in FIG. 2) or the approximately concentrically arranged circular markings or perforations (for example and without limitation, in place of the approximately circular markings or perforations 50 shown in FIG. 2). The foregoing markings or perforations can be configured to assist a user in folding the cup cover 40 over the rim of the glass. In this arrangement, or any arrangements disclosed herein, the cover can be configured such that only light pressure and/or simple hand movements will form or collapse the cover over the rim of the glass.

Figure 3:
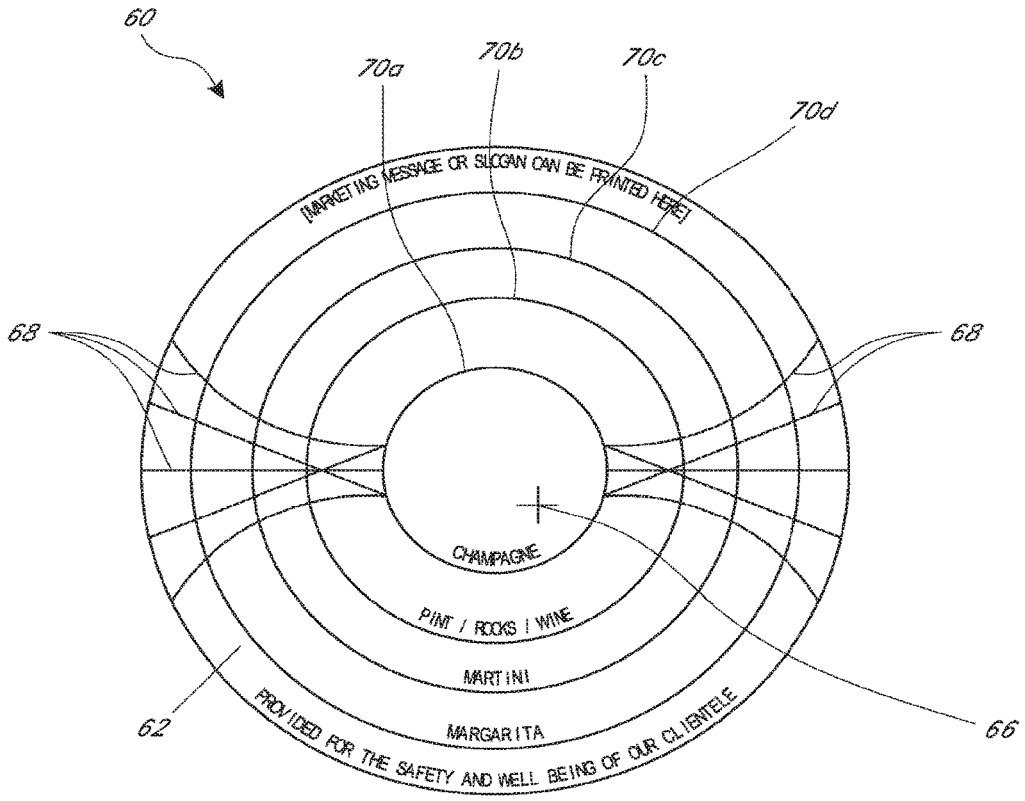
FIG. 3 is a top view of an embodiment of a cup cover, showing an arrangement of text and approximately concentrically positioned circles marked on at least a top surface of the cup cover and an arrangement of curved perforations formed through at least a portion of the thickness of the cover.

FIG. 3 is a top view of an embodiment of a cup cover 60, showing an arrangement of exemplifying text and approximately concentrically positioned circles 70 marked on at least a top surface of the cup cover 60. The embodiment of the cover 60 illustrated in FIG. 3 also can have an arrangement of curved perforations 68 and circular perforations 70 formed through at least a portion of the thickness of the cover 60. The circular perforations 70 can be positioned coincident with circular markings on at least the top surface of the cup cover 60.

As with the cover 60 described above, cover 60 can have a first ring 70*a* having a diameter that is approximately equivalent to a diameter of a champagne glass. In this configuration, a user may position a champagne glass against the bottom surface of the cover 60 and align a rim of the champagne glass with ring 70*a* so that a user positioning the cover 60 over a champagne glass can cause the cover 60 to collapse about the glass tightly, securely, and easily.

Similarly, the cover 60 can have a second ring 70*b* concentric to the first ring 70*a*, the second ring 70*b* having a diameter suitable for use with, for example and without limitation, a pint glass, rocks glass, or a wine glass. Further, the cover 60 can have a third ring 70*c* that can be concentric to the first ring 70*a*, the third ring 70*c* having a diameter suitable for use with, for example and without limitation, a martini glass. Some embodiments of the cover 60 can have a fourth ring 70*c* that can be concentric to the first ring 70*a*, the fourth ring 70*d* having a diameter suitable for use with, for example and without limitation, a margarita glass.

Figure 4:
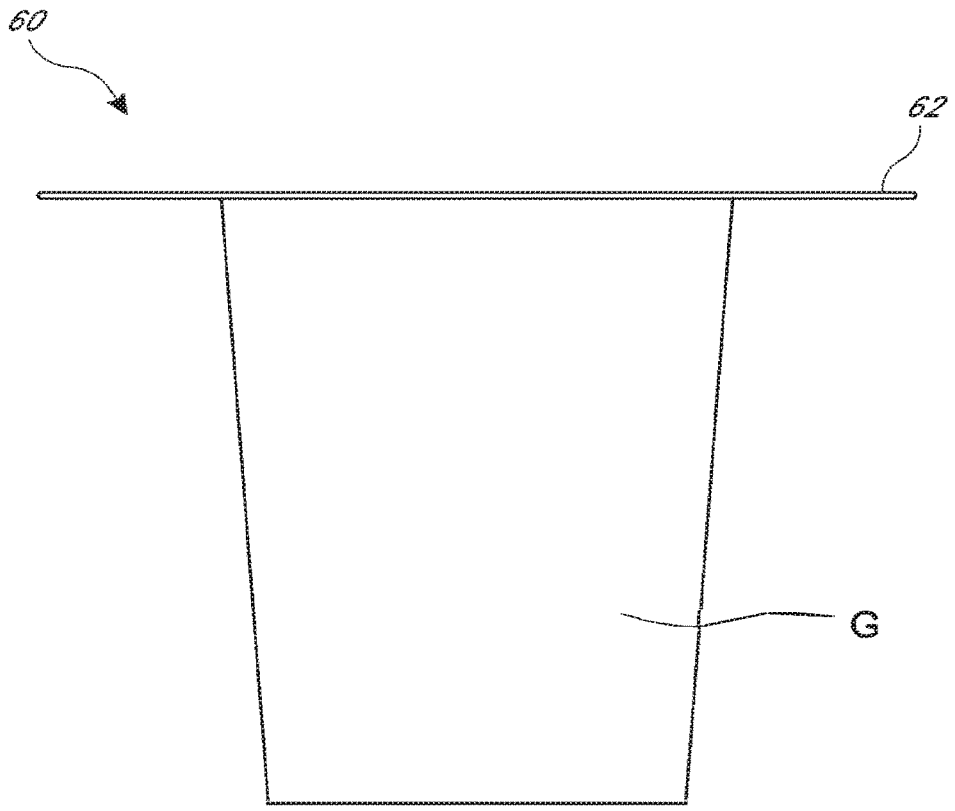
FIG. 4 is a side view of the embodiment of the cup cover shown in FIG. 3 positioned over the top of a glass, showing the cup cover being in a generally planar or pre-folded state.

FIG. 4 is a side view of the embodiment of the cup cover 60 shown in FIG. 3 positioned over the top of a glass G, showing the cup cover 60 being in a generally planar or pre-folded state. As shown in FIG. 4, cover 60 can be placed over the top of the glass G so that the opening of the glass G is covered by the cover 60. The cover 60 can be used in this state, or can be folded as illustrated in FIG. 5 such that the peripheral portions of the cover 60 are folded over the rim of the glass and into contact with the side walls of the glass.

Figure 5:
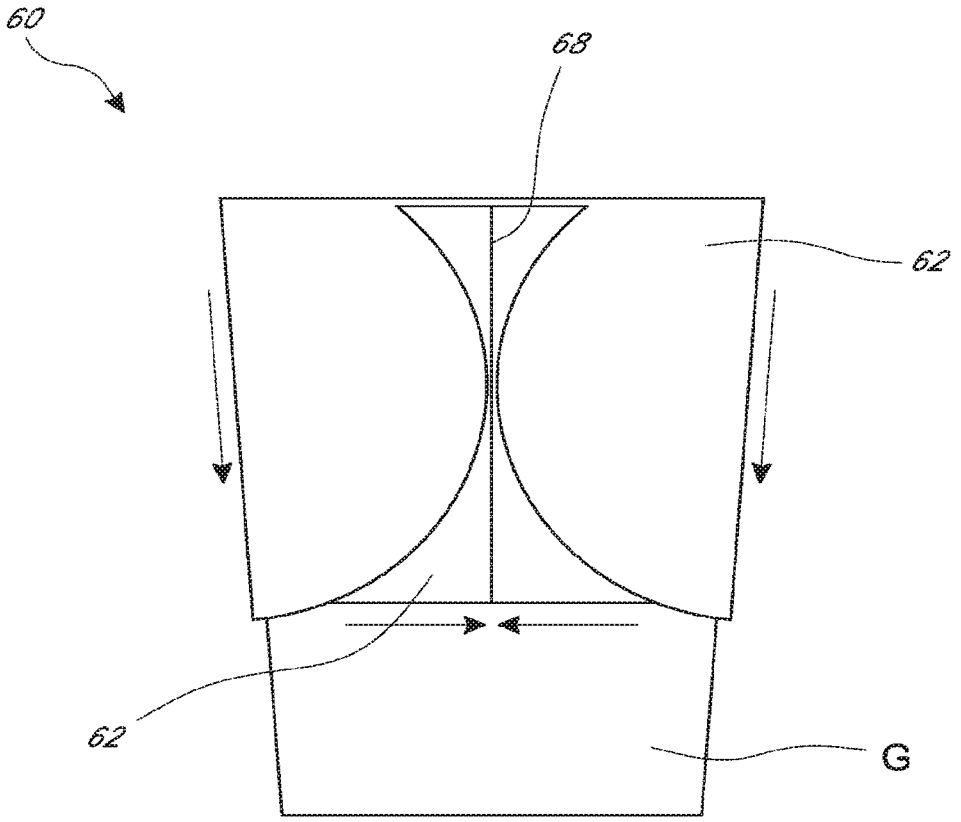
FIG. 5 is a side view of the embodiment of the cup cover shown in FIG. 3 positioned over the top of a glass, showing a peripheral portion of the cup cover folded over the rim of the glass.

FIG. 5 is a side view of the embodiment of the cup cover 60 shown in FIG. 3 positioned over the top of a glass, showing a peripheral portion of the cup cover 60 folded over the rim of the glass. In any embodiments disclosed herein, without limitation as described below, the cover can be made from a material that causes at least some of the peripheral portions of the cover to cling, adhere, or otherwise stay in approximate contact with the side walls of the glass. In any embodiments disclosed herein, the cover 60 can be tightly or firmly folded over the rim of the glass, as shown in FIG. 5. Alternatively, in any embodiments disclosed herein, the cover 60 can be configured such that the cover does not adhere to the side wall of the glass, at least some of the peripheral portions of the cover being able to spring or otherwise move away from the side walls of the glass while still maintaining an acceptable seal over the opening of the glass to prevent unwanted contamination from entering the glass.

In any of the embodiments disclosed herein, the perforations can bias the cover to fold along the perforations so that the cover is biased to collapse in a particular shape around the glass according to the shape and position of the perforations. For example, the embodiment of the cover illustrated in FIG. 5 can be perforated to form a clamshell shaped cover to seal around the opening of the glass.

Figure 6:
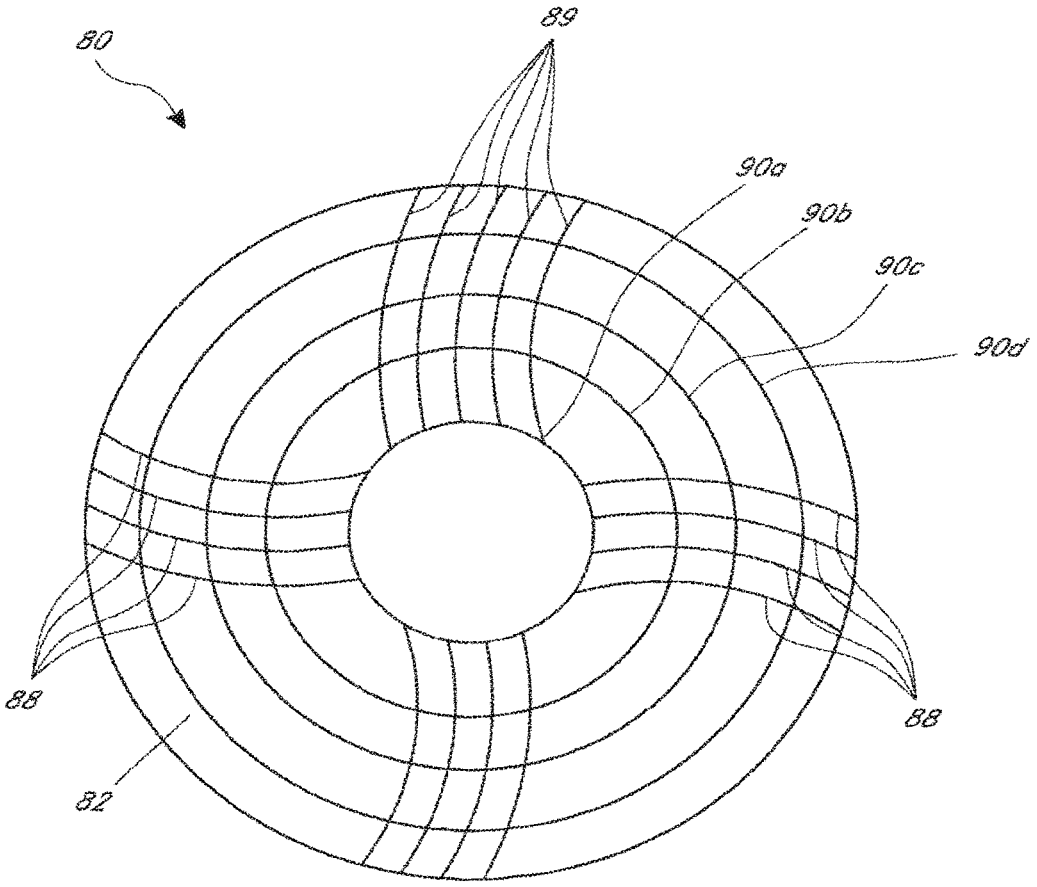
FIG. 6 is a top view of an embodiment of a cup cover, showing an arrangement of curved perforations formed through at least a portion of the thickness of the cover.

FIG. 6 is a top view of an embodiment of a cup cover 80, showing an arrangement of curved perforations formed through at least a portion of the thickness of the cover. The cover illustrated in FIG. 6 can have any of the same or similar features of any other cover embodiment disclosed herein, including without limitation, having approximately concentric circular perforated rings 90*a*, 90*b*, 90*c*, and 90*d* formed through the top surface 82 of the cover 80, similar to the approximately concentric circular rings of the embodiment described and illustrated in FIG. 3.

Additionally, as illustrated in FIG. 6, the cover 80 can have a plurality of curved perforations 88, 89 in a generally radial arrangement. For example, in any embodiments disclosed herein, the cover 80 can have a first set of curved perforations 88 projecting radially from a center portion of the cover 80 as well as similar curved perforations 88 projecting symmetrically in an opposite direction. In some embodiments, a first set of curved perforations 88 can project in a first direction away from a center portion of the cover 80 and a second set of curved perforations 88 can project in a second direction away from a center portion of the cover 80 that is approximately 180 degrees from the first direction, or approximately 120 degrees from the first direction, or approximately 90 degrees (as with curved perforations 89) away from the first direction. In some embodiments, the first direction and the second direction can be between 90 and 180 degrees, inclusive, apart.

Figure 7:
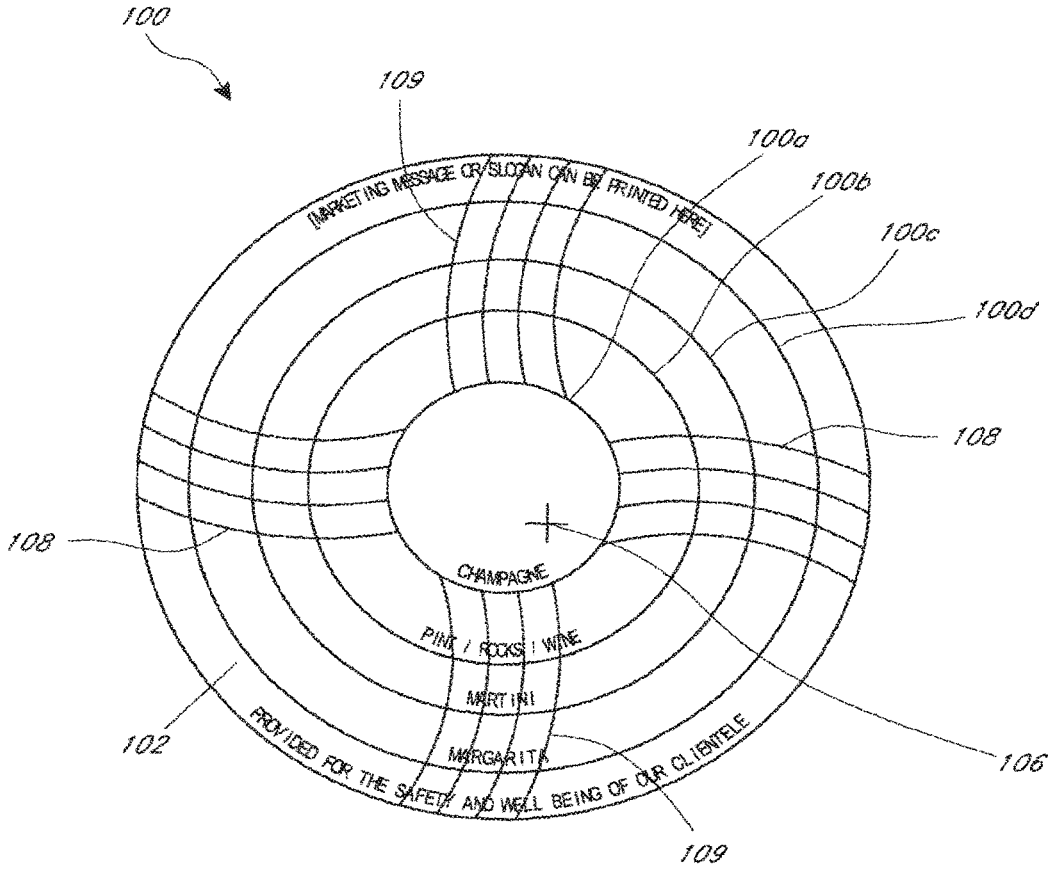
FIG. 7 is a top view of an embodiment of a cup cover, showing an arrangement of text and approximately concentrically positioned circles marked on at least a top surface of the cup cover, as well as an arrangement of curved perforations formed through at least a portion of the thickness of the cover.

FIG. 7 is a top view of an embodiment of a cup cover 100, having an arrangement of text and approximately concentrically positioned circles marked on at least a top surface 102 of the cup cover 100. The cover illustrated in FIG. 7 can have any of the same or similar features of any other cover embodiment disclosed herein, including without limitation, having the circular markings 100*a*, 100*b*, 100*c*, or 100*d* or text markings of the embodiment described above with respect to FIG. 3 and having one or more sets of curved perforations 108, 109 projecting from a center portion of the cover 100.

The cover illustrated in FIG. 7 also can have an arrangement of curved perforations formed through at least a portion of the thickness of the cover and/or circular perforations corresponding to the circular markings on the cover. The perforations or perforation design can allow for a foldable, fitted cover to be formed around the rim of glass, in the varying sizes represented by the circular perforated rings on the embodiment of the cup cover 100 illustrated therein. These specific perforations, which may be described as the "pin-wheel" design, can grip around the rim of the glass, creating a more securely affixed preventative cup cover 100.

The curved perforations can be formed in a wavy arrangement. In some embodiments, the curved perforations can have a spinning wheel or pinwheel type shape. Similar to the perforations of other embodiments described herein, as mentioned, the curved perforations can assist the user in wrapping the cover around the opening of the glass.

Figure 8:
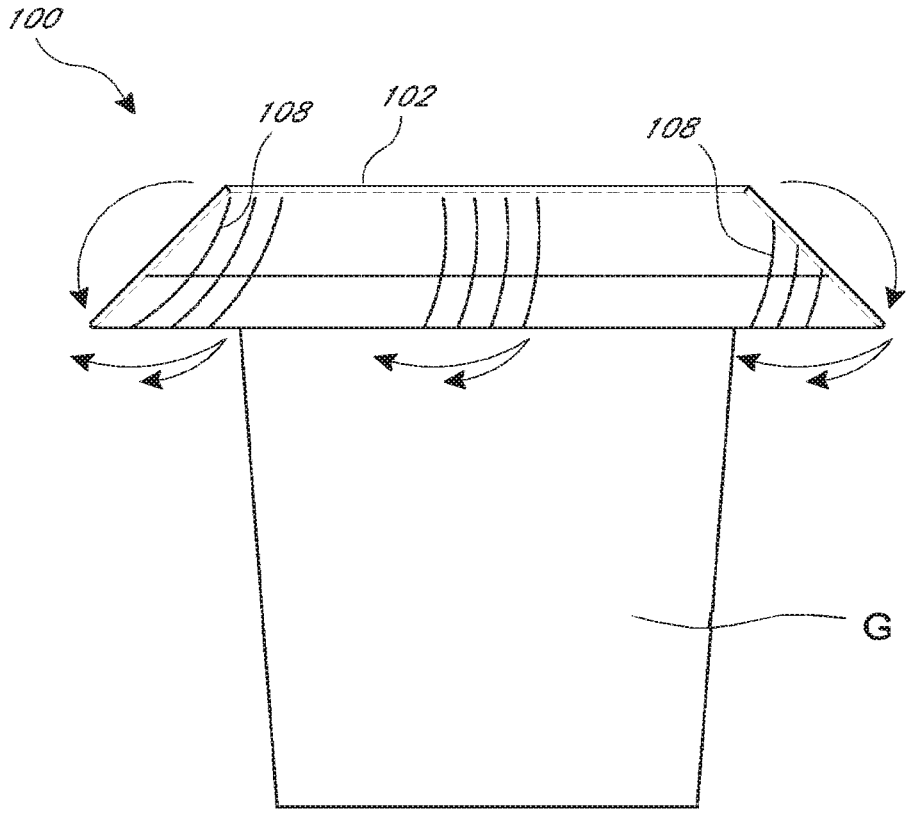
FIG. 8 is a side view of the embodiment of the cup cover of FIG. 7, showing a peripheral portion of the cup cover partially folded over the rim of the glass.
Figure 9:
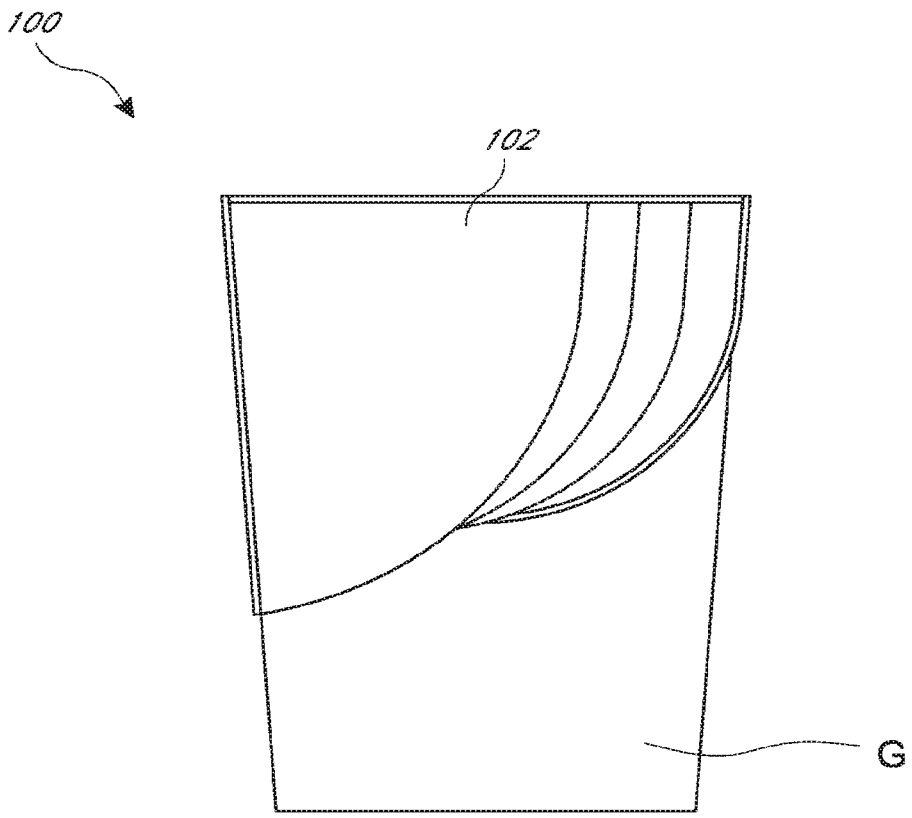
FIG. 9 is another side view of the embodiment of the cup cover of FIG. 7, showing a peripheral portion of the cup cover folded over the rim of the glass.

FIG. 8 is a side view of the embodiment of the cup cover 100 of FIG. 7, showing a peripheral portion of the cup cover 100 partially folded over the rim of the glass G. In this configuration, a user to can wrap the cover around the glass by positioning the cover over the glass, approximately aligning the rim of the glass with the appropriate sized circular marking. The user can then bend or fold the peripheral portions of the cover over the rim of the glass, as indicated by the arrows shown in FIG. 8. The user can simultaneously apply a twisting motion to more uniformly collapse the cover around the glass, potentially creating a tighter seal around the glass, as illustrated in FIG. 9, which is another side view of the embodiment of the cup cover 100 of FIG. 7, showing a peripheral portion of the cup cover 100 folded over the rim of the glass.

Figure 10:
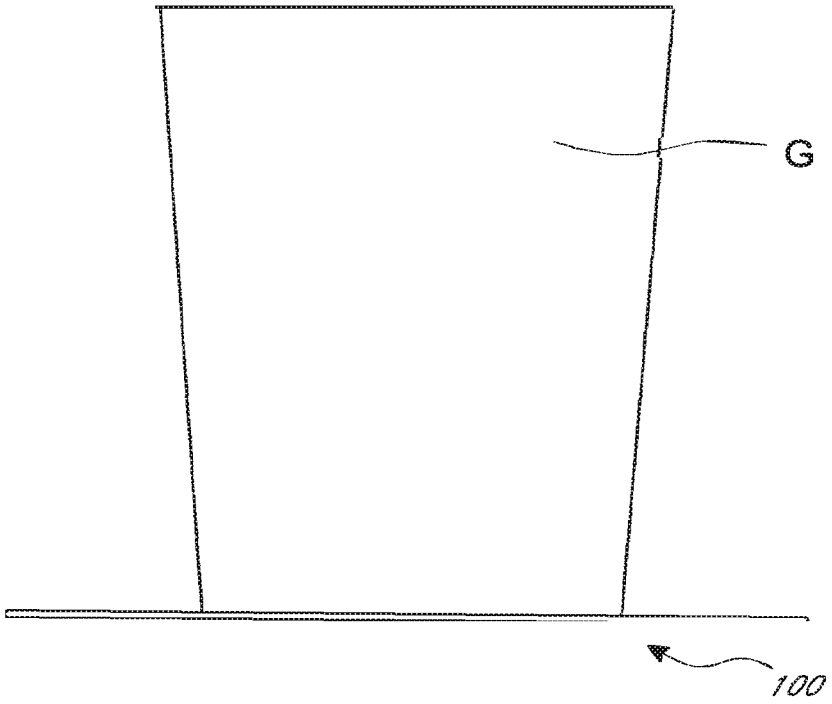
FIG. 10 is a side view of an embodiment of a cup cover positioned under the bottom of a glass.
Figure 11:
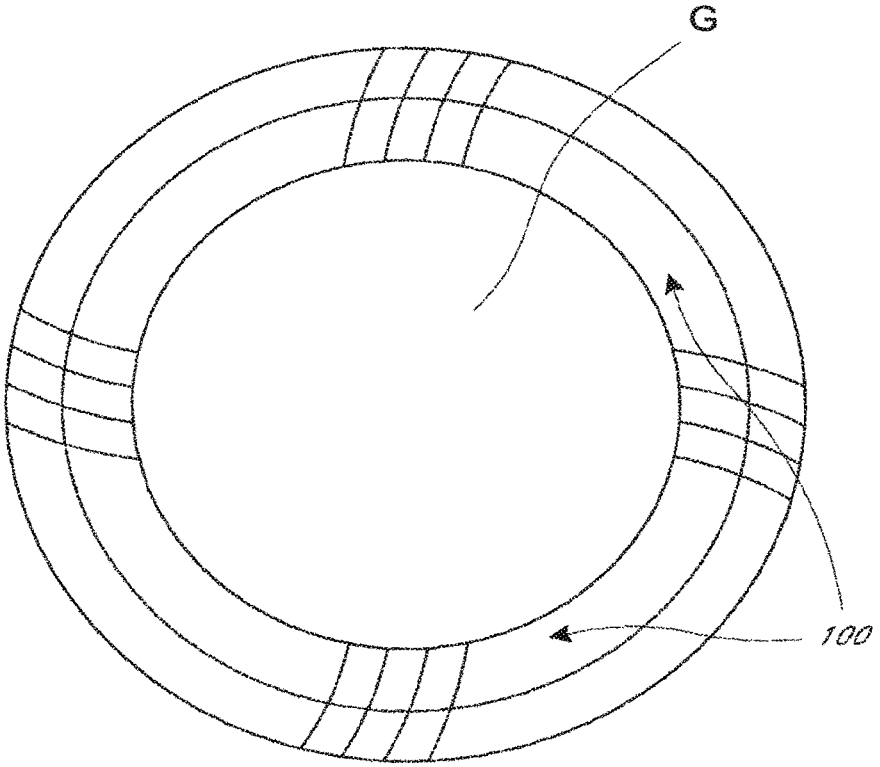
FIG. 11 is a top view of the embodiment of the cup cover illustrated in FIG. 10 positioned under the bottom of the glass.

FIG. 10 is a side view of an embodiment of a cup cover 100 positioned under the bottom of a glass G, and FIG. 11 is a top view of the embodiment of the cup cover 100 illustrated in FIG. 10 positioned under the bottom of the glass. With reference to FIGS. 10 and 11, the cup cover 100 can be used as a coaster for the glass prior to, or even after, being used as a cup cover 100.

In any of the embodiments disclosed herein, the cup cover can have a circular, square, or any other suitable shape. The cup cover can have a diameter or size that is approximately 5.875 inches, or between 5 and 6 inches, or between 4 and 7 inches. The diameter of the cover can be larger for larger glasses, or smaller for smaller glasses. The thickness of the material can vary according to a variety of factors, such as without limitation, the desired material, desired transparency or opaqueness, and the desired application of the cover. Any embodiments of the cover can have a thickness that is approximately equal to a sheet of paper, a sheet of cardstock, or similar to any suitable paper based disposable coasters.

Any of the cover embodiments disclosed herein can be made from any suitable material. Examples of materials that can be used to make the cover include standard paper, cotton paper, various kinds of napkin paper or tissue paper, paper mesh, tissue coaster paper, various kinds of coaster paper, carbonless paper or material, natural weaves, synthetic paper, synthetic materials such as plastic, which can be formed into thin plastic films, natural and synthetic blends, and any combination of the foregoing. The material can be hydrophobic, hydrophilic, or otherwise. In any embodiments disclosed herein, the cover can be made from a tissue/coaster paper blended with synthetic paper or a synthetic material for water/moisture proofing the cup cover. In any embodiments disclosed herein, at least one surface of the cover can be coated with a synthetic material, such as, without limitation, a waterproof or water resistant coating to prevent the cover from absorbing liquid or moisture. The selection of the material and/or coatings will depend on particular constraints, such as functionality and cost effectiveness.

Additionally, in any embodiments disclosed herein, the cover can have a pull string around a periphery thereof. The cover can be configured such that pulling or withdrawing the pull string after the cover has been placed over the rim of the glass can constrict the periphery of the cover to collapse around the side walls of the glass.

In any of the embodiments disclosed herein, the material of the cover can be transparent or semi-transparent so that a user can see the contents of the glass, and also potentially visually detect the presence of any unwanted contaminants. A thin film, clear plastic material or a reasonably transparent or translucent paper or synthetic material, or any other suitable material or combination of materials can be used for the cover.

Any embodiments of the cup cover disclosed herein can have an adhesive coated on at least a portion of the cover. For example, in any embodiments disclosed herein, the cover can have adhesive coated on the second, or underside, surface of the cover. The adhesive can be formed around at least a portion of the periphery of the cover. The adhesive can be liquid activated such that the cling or grip of the adhesive to the target glass increases as the adhesive comes in contact with moisture or liquid. In some embodiments, release layer or other protective layer can be positioned over the adhesive such that the adhesive is exposed by removal of the protective layer.

Additionally, the cup cover can have coatings, chemicals, inks, or other additives configured to change the appearance of the cover when the cover or the contents of the glass are exposed to one or more particular contaminants. For example, in some embodiments, the cover can be configured to change color when the cover and/or the contents of the glass are exposed to a substance such as Chlorol Hydrate, Rohypnol, GHB, or Ecstasy.

Any of the curves, circles, text, or other markings described herein can be marked on at least one of the surfaces of the cover by any conventionally known or later developed techniques, such as printing (including ink printing, silk-screen printing, or laser printing), burning, stamping, or otherwise. In some embodiments, the same or similar markings can be made on the second, opposite side of the cover.

As discussed and illustrated, any of the embodiments of the covers can be marked with approximately concentric circles corresponding to one or more glasses, such as red or white wine glasses, champagne glasses, pint glasses, margarita glasses, tumblers, martini glasses, beer, soda, or other beverage cans, and bottles. Each of the plurality of circles can be marked with the beverage or beverages corresponding with the circle so that a user can quickly determine which circle to align the rim of the glass with.

The cover can additionally or alternatively be marked with any other text, artwork, illustrations, or other markings as desired. The cover can be used to advertise different brands of alcohol or drink types. The cover can also display the cover manufacturer's name, the bar, restaurant, or hotel owner's name, icon, or trademark, slogans, sponsors, sporting teams, or any other name, brand, illustration, or otherwise that is desired.

The perforations of any cover embodiment disclosed herein can be formed through all or a portion of the thickness of the cup cover. The selection of the depth of the perforations can depend on the material selected, the number of layers that the cover can comprise, if more than one, or other factors.

In any embodiments disclosed herein, the cover can comprise a perforated layer laminated to a second layer that is not perforated. The first and second layers can be formed from the same or from a different material. In any embodiments disclosed herein, the cover can be formed from more than two layers of material, having three or more same or different layers and/or materials therein. One or more of the layers can be waterproof or water resistant, and can be perforated or non-perforated. Further, in some embodiments, the circular perforations can be in one layer, while other perforations are in another layer.

Figure 12:
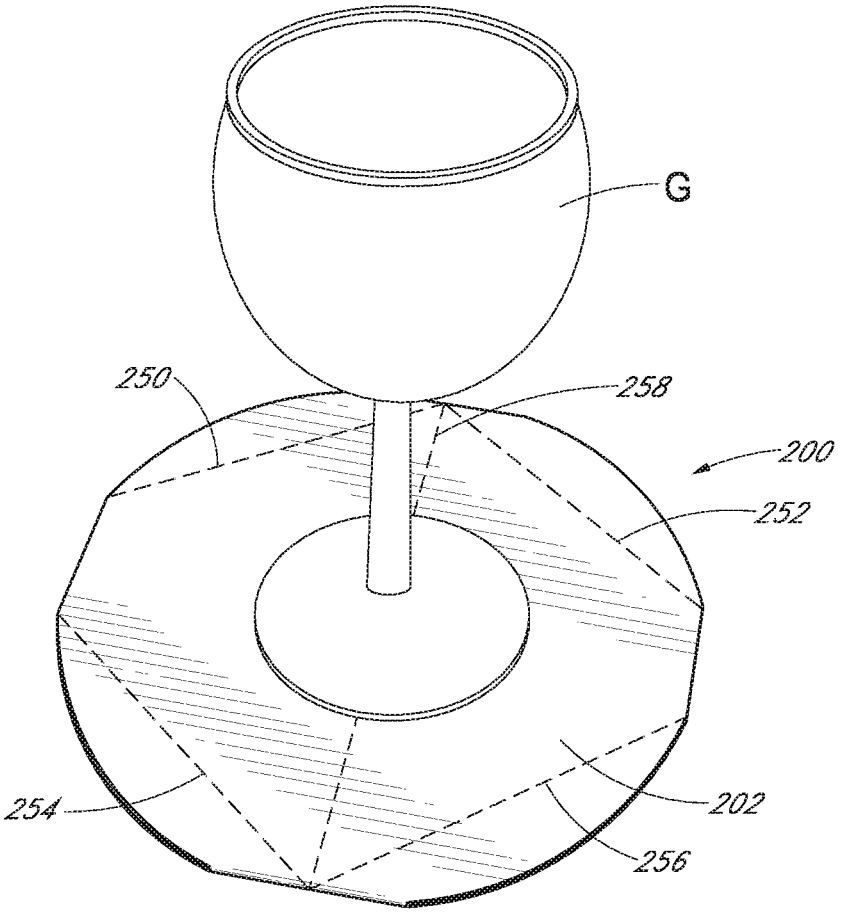
FIG. 12 shows another embodiment of a cover member that can be used to cover a drinking container from unwanted contamination, showing the cover member in a first or planar state.

FIG. 12 shows another embodiment of a cover member 200 (also referred to herein as a cover) that can be used to cover a drinking container from unwanted contamination, showing the cover member 200 in a first or planar state. The cover member 200 can have any of the same features, shapes, components, materials, markings, indentations, and/or any of the other details of any of the other embodiments disclosed herein. Additionally, any of the other cover member embodiments disclosed herein can have any of the same features, shapes, components, materials, markings, indentations, and/or any of the other details related to any of the embodiments of the cover member 200 disclosed herein.

Figure 13:
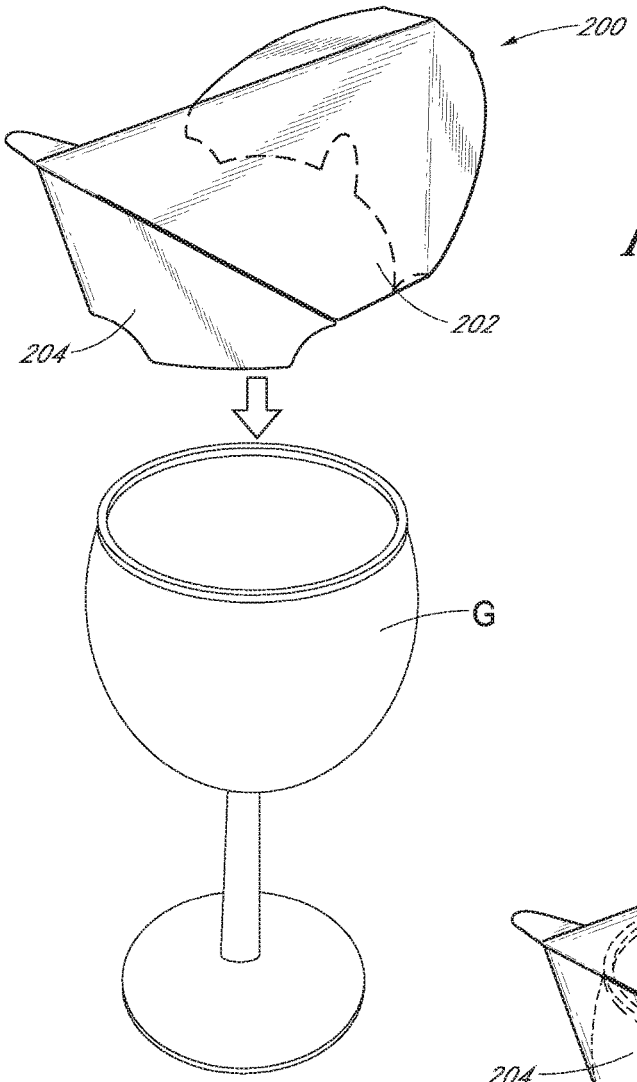
FIG. 13 shows the embodiment of the cover member of FIG. 12 in a second state or open configuration wherein the cover member is in a nonplanar state and in which the cover member can be positioned over the top of a glass.

As shown, the cover member 200 can be positioned under a glass G when the cover member 200 is in the first state. Thus, in this first state, as shown in FIG. 12, the cover member 200 can be generally planar in orientation and shape, and can be used just like a typical coaster would be used on a bar or table surface or otherwise. FIG. 13 illustrates the cover member 200 in a second state or open configuration wherein the cover member is in a nonplanar state and in which the cover member 200 can be positioned over the top of a glass G. In any embodiments disclosed herein, when the cover member is in the second state, at least one of the first flap portion or tab portion (also referred to as a flap element or tab element, or just as a flap or tab), the second flap portion or tab portion (also referred to as a flap element or tab element, or just as a flap or tab), and the main body portion can be in a nonplanar orientation or state. When the illustrated embodiment of the cover member 200 is in the second state, the main body portion 202 (also referred to herein as a middle portion), the first flap portion 204, and the second flap portion 206 are all in a nonplanar state or configuration.

Figure 14:
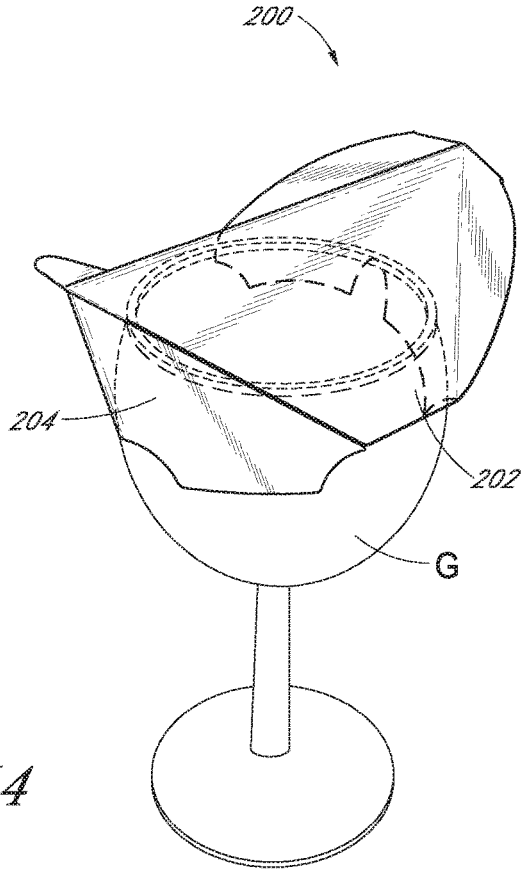
FIG. 14 shows the embodiment of the cover member of FIG. 12 positioned over the opening of the glass G so as to cover the opening of the glass to prevent unwanted contamination from entering the glass without removing or lifting the cover from the glass.

FIG. 14 shows the cover member 200 positioned over the opening of the glass G so as to cover the opening of the glass to prevent unwanted contamination from entering the glass without removing or lifting the cover from the glass. In any embodiments disclosed herein, the cover member 200 or any cover member disclosed herein can completely cover or substantially completely cover the opening of the glass so as to inhibit unwanted contamination from entering the glass while the cover member is positioned over the glass.

Cover member 200 is configured such that, when the cover member is in the first state, the first and second flap portions provide a barrier to prevent or at least inhibit any contamination, dirt, liquid or other substances from contacting a second surface (which is the underside surface) of the main body portion as well as the inside surface of the flap portions. In this configuration, when the cover member 200 is moved to the second position and positioned over a glass or other drinking container, the protected inside surfaces of the first and second flap portions and the main body portion of the surfaces of the cover member that may directly contact the glass or other drinking container. In this arrangement, the glass or drinking container is further protected from any contamination, dirt, liquid, or other substances that may be on the bar or on one or more of the outside surfaces of the coaster. Additionally, any embodiments of the cover member disclosed herein, including without limitation the embodiment of the cover member 200, can be configured to at least substantially cover the opening of the drinking container without stretching any portion of the cover member.

Any of the embodiments of the cover member disclosed herein, including without limitation cover member 200, can be configured to be quickly and easily changed from the first state, in which the cover member is in a generally planar state, to the second state in which the cover member is ready to be positioned over the glass. Additionally, in any embodiments disclosed herein, the cover member can be configured to constrict around the outside of the glass. For example and without limitation, a cover member 200 can be made from a semi-resilient material such as paper and can be formed with creases to assist in folding or bending of the main body portion and flap portions about the creases or bend lines. In any embodiments disclosed herein, the cover member (including, without limitation, the cover member embodiment 200) can be made entirely from a non-stretchable material or from non-stretchable materials.

The paper can be dyed or colored to any desirable color or pattern of colors and have any desirable printing thereon to instruct the user of the best way to use the cover member and also to have advertising or promotional messaging. Additionally, the cover member and/or any portions thereof can have a substantially water resistant coating thereon or be made from a substantially water resistant material to inhibit the absorption of liquid by the cover member or any components thereof.

For example, in any embodiments herein, all or any portion or portions of the cover member can be made from paper (such as a thick card stock paper), or any paper having a thickness of approximately 0.014 inch, or from approximately 0.01 inch or less to 0.03 inch or more, or from approximately 0.012 inch to approximately 0.017 inch. Again, the paper can have any number of markings, text, instructions, coloring, folds or creases, cutouts or other similar features, and/or a water resistant coating thereon in any embodiments of the cover member disclosed herein.

Additionally, any embodiments of the cover or cover members disclosed herein can have any desirable outer shape and or size. For example and without limitation, the cover member 200 can be sized so that the cover member is approximately 4.5 inches across when the cover member is in the first, or planar state or configuration. Additionally, the cover member 200 can be sized so that the cover member is from approximately 4 inches or less to approximately 5 inches or more across, or from approximately 4 inches or less to approximately 6 inches or more across, when the cover member is in the first, or planar state or configuration. For covers designed for larger drink containers, such as margarita glasses, pitchers, or other similar containers, the cover member can be from approximately 6 inches or less to approximately 8 inches or more across.

When the flap portions are opened to move the cover member to the open configuration or second state, which can be but is not required to be done by moving the flap portions in opposing directions, the flap portions can be biased by the substrate material and design to somewhat oppose the movement in opposite directions. In this configuration, when the opposing force applied to the two flap portions is removed, the flap portions can move toward one another, or generally from the second state (or second position) back toward the first state (or first position), so as to constrict around an outside surface of the glass.

As illustrated, cover member 200 can have a main body portion 202, a first flap portion 204 coupled with the main body portion 202 and a second flap portion 206 coupled with the main body portion 202. Additional flap portions can be coupled with the main body portion as desired. The first flap portion and the second flap portion can be sized, shaped, and otherwise be configured to be generally identical and/or symmetric about a centerline CL of the cover member 200. In some embodiments, when the first flap portion is in the second position, a ridge (such as ridge 211 shown in FIG. 18) will generally be formed in the first flap portion such that the first flap portion is nonplanar. Similarly, when the second flap portion is in the second position, a ridge (such as ridge 213 shown in FIG. 18) will be generally formed in the first flap portion such that the first flap portion is nonplanar.

Additionally, the first flap portion 204 can have a first cutout 210 and the second flap portion 206 can have a first cutout 212 positioned near the center of the cover member to permit a user to have access to a center portion 202*a* of the main body portion 202 of the cover member. In any embodiments disclosed herein, for example, the cover member may be changed from the first state or position to the second state or position by exerting a force against the center portion 202*a* of the main body portion 202 to deflect the center portion 202*a* of the main body portion 202. In some embodiments, the user can also spread the first flap portion 204 away from the second flap portion 206 to move the flap portions from the first position to the second position, respectively, so as to change the cover member from the first state to the second state. Or, in some embodiments, both of these steps can be done at the same time.

Figure 17:
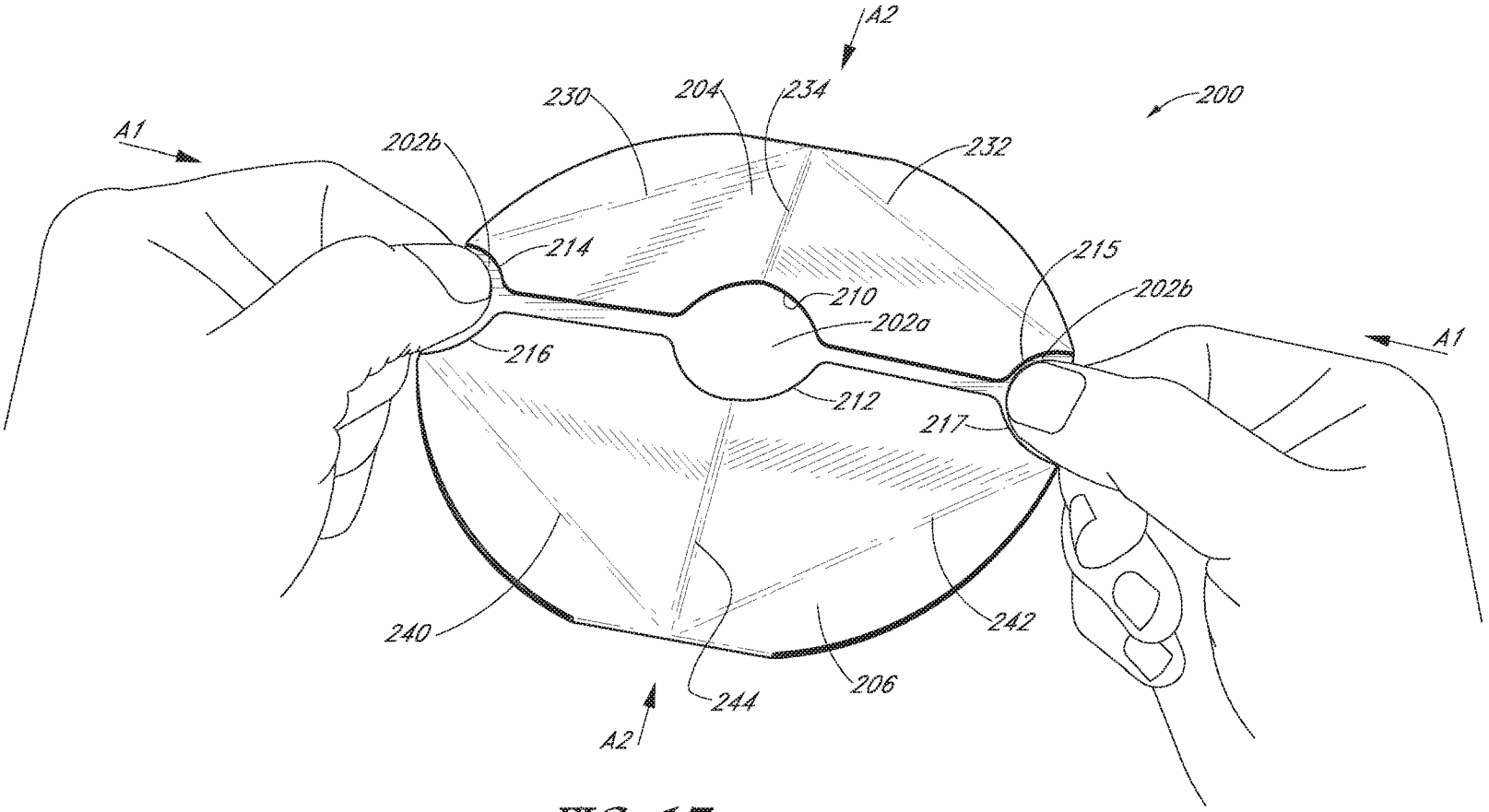
FIG. 17 shows the embodiment of the cover member of FIG. 12 being grasped and manipulated by a user's hands.

In any embodiments disclosed herein, the first flap portion 204 can have a second cutout 214 and a third cutout 215, and the second flap portion 206 can have a second cutout 216 and a third cutout 217 positioned near the lateral edges of the flap portions to permit access by the user to the lateral edge portions 202*b* of the main body portion 202. With reference to FIG. 17, the user can grasp the cover member 200 by grasping the lateral edge portions 202*b* of the main body portion 202 and exert an inward force (i.e., in the inward direction A1 as shown in FIG. 17) to deflect the first and second flap portions 204, 206 outwardly and, therefore, to change the cover member from the first state to the second state. To change the cover member from the second state to the first state, the user can grasp the lateral edge portions 202*b* of the main body portion 202 and exert an outward force (i.e., in the opposite direction as direction A1) to deflect the first and second flap portions 204, 206 inwardly.

In any embodiments disclosed herein, the first flap portion 204 and/or the second flap portion 206 can have a plurality of preformed creases formed in the first flap portion during the manufacturing of the cover member, the creases being configured to bias the first flap portion and/or second flap portion to bend or fold about the creases to make the first flap portion 204 move to the second state when particular forces are applied to the cover member. For example and without limitation, the first flap portion 204 and/or the second flap portion 206 can have a plurality of preformed creases formed therein configured to bias the flaps to bend or fold about the creases to make the first flap portion 204 and/or second flap portion 206 move to the second state when the sides of the cover member are forced or squeezed together, for example in the direction A1 described above.

Figure 15:
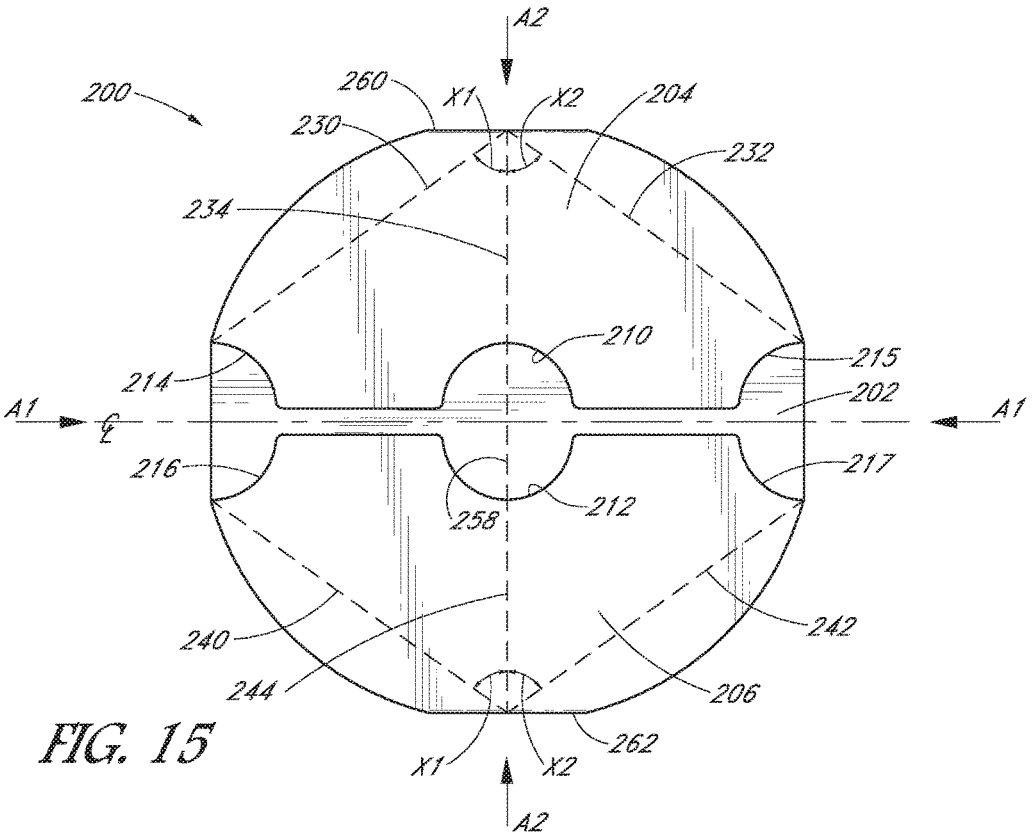
FIG. 15 is a bottom view of the embodiment of the cover member of FIG. 12, showing the bottom side of the cover member.

For example and without limitation, the first flap portion 204 can have a first crease 230, a second crease 232, and a third crease 234 formed in the first flap portion. With reference to FIG. 15, the third crease 234 can be formed along a centerline of the first flap portion 204 in a direction A2 that is approximately perpendicular to the direction A1. The third crease 234 can be formed along the entire length of the first flap portion in the direction A2. The first crease 230 can be formed at an angle X1 relative to the direction of the third crease 234. In any embodiments disclosed herein, the first crease 230 can be formed at an angle that is approximately 52.5 degrees relative to the third crease 234, or from approximately 45 degrees to approximately 60 degrees, or from approximately 50 degrees to approximately 55 degrees relative to the third crease 234, or from or to any values within this range, depending on the size and geometry of the first flap portion.

Similarly, in any embodiments disclosed herein, the second crease 232 can be formed at an angle X2 relative to the direction of the third crease 234. In any embodiments disclosed herein, the second crease 232 can be formed at an angle that is approximately 52.5 degrees relative to the third crease 234, or from approximately 45 degrees to approximately 60 degrees, or from approximately 50 degrees to approximately 55 degrees relative to the third crease 234, or from or to any values within this range, depending on the size and geometry of the first flap portion. The second crease 232 can be symmetrical to the first crease 230 about a line projecting through the third crease 234. The cover can be configured such that, when the first flap portion is moved to the second position, the third crease 234 of the first flap portion can rotate from approximately 0° (i.e., wherein the third crease 234 is generally coincident with the planar surface of the first flap portion when the first flap portion is in the first position, wherein the plane defined by the first flap portion when the first flap portion is in the first position is herein referred to as the first position plane) to approximately 90° relative to the first position plane.

The second flap portion 206 can have a first crease 240, a second crease 242, and a third crease 244 formed in the second flap portion. With reference to FIG. 15, the third crease 244 can be formed along a centerline of the second flap portion 206 in a direction A2 that is approximately perpendicular to the direction A1. The third crease 244 can be collinear to the third crease 234 of the first flap portion. The third crease 244 can be formed along the entire length of the second flap portion in the direction A2. The first crease 240 can be formed at an angle X1 relative to the direction of the third crease 244. In any embodiments disclosed herein, the first crease 240 can be formed at an angle that is approximately 52.5 degrees relative to the third crease 244, or from approximately 45 degrees to approximately 60 degrees, or from approximately 50 degrees to approximately 55 degrees relative to the third crease 244, or from or to any values within this range, depending on the size and geometry of the first flap portion.

Similarly, in any embodiments disclosed herein, the second crease 242 can be formed at an angle X2 relative to the direction of the third crease 244. In any embodiments disclosed herein, the second crease 242 can be formed at an angle that is approximately 52.5 degrees relative to the third crease 244, or from approximately 45 degrees to approximately 60 degrees, or from approximately 50 degrees to approximately 55 degrees relative to the third crease 244, or from or to any values within this range, depending on the size and geometry of the first flap portion. The second crease 242 can be symmetrical to the first crease 240 about a line projecting through the third crease 244. The cover can be configured such that, when the second flap portion is moved to the second position, the third crease 244 of the second flap portion can rotate from approximately 0° (i.e., wherein the third crease 234 is generally coincident with the planar surface of the second flap portion when the second flap portion is in the first position, wherein the plane defined by the second flap portion when the second flap portion is in the first position is herein referred to as the first position plane) to approximately 90° relative to the first position plane.

Figure 16:
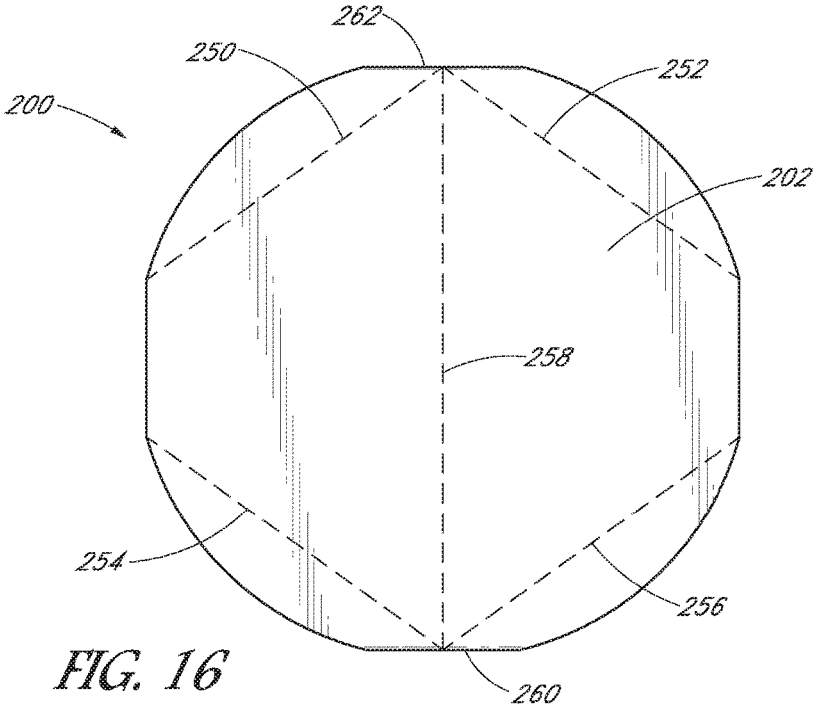
FIG. 16 is a top view of the embodiment of the cover member of FIG. 12, showing the top side of the cover member.

With reference to FIG. 16, the main body portion 202 can have a plurality of creases configured to assist the cover member in transforming from the first state to the second state. For example and without limitation, the main body portion 202 can have a first crease 250, a second crease 252, a third crease 254, a fourth crease 256, and a fifth crease 258. In the illustrated embodiment, the first crease 250 formed in the main body portion can be positioned to approximately align with the first crease 240 of the second flap portion 206 so that the main body portion and the second flap portion can bend or deflect about the creases 240, 250 simultaneously. Additionally, the second crease 252 of the main body portion can be positioned to approximately align with the second crease 242 of the second flap portion 206 so that the main body portion and the second flap portion can bend or deflect about the creases 242, 252 simultaneously.

The third crease 254 formed in the main body portion 202 can be positioned to approximately align with the first crease 230 of the first flap portion 202 so that the main body portion and the first flap portion can bend or deflect about the creases 230, 254 simultaneously. Further, the fourth crease 256 formed in the main body portion 202 can be positioned to approximately align with the second crease 232 of the first flap portion 202 so that the main body portion and the first flap portion can bend or deflect about the creases 232, 256 simultaneously. Finally, the third crease 258 of the main body portion 202 can be positioned to approximately align with the third crease 234 of the first flap portion 204 and the third crease 244 of the second flap portion 206 so that the main body portion, the first flap portion, and the second flap portion can bend or deflect about the creases 234, 244, and 258 simultaneously, so as to form a ridge in the first flap portion (such as ridge 211, shown in FIG. 18), a ridge in the second flap portion (such as ridge 213, shown in FIG. 18, and a ridge in the main body portion (such as ridge 215, shown in FIG. 18).

In any embodiments disclosed herein, the cover can have a first flap portion that is rotatable along at least one axis (for example, without limitation, the axis can coincide with one of the creases, such as crease 230) such that, when the first flap portion is in the second position, the portion of the first flap portion distal to the rotation axis can extend away from the main body portion so that the first flap portion can be positioned around an opening of a drinking container, as described above. The axis can also be considered to form a line of contact with the main body portion. Additionally, in any embodiments disclosed herein, the cover can have a first flap portion that is rotatable along a first axis and a second axis simultaneously. For example, without limitation, the axes can coincide with two of the creases, such as creases 230, 232). The first flap portion can have a crease or other feature therein to permit a portion of the first flap portion that extends away from the main body portion to bend.

The cover can also have a second flap portion that is rotatable along at least one axis (for example, without limitation, the axis can coincide with one of the creases, such as crease 240) such that, when the second flap portion is in the second position, the portion of the second flap portion distal to the rotation axis can extend away from the main body portion so that the second flap portion can be positioned around an opening of a drinking container, as described above. The axis can also be considered to form a line of contact with the main body portion. Additionally, in any embodiments disclosed herein, the cover can have a second flap portion that is rotatable along a first axis and a second axis simultaneously. For example, without limitation, the axes can coincide with two of the creases, such as creases 240, 242). The second flap portion can have a crease or other feature therein to permit a portion of the first flap portion that extends away from the main body portion to bend.

Figure 18:
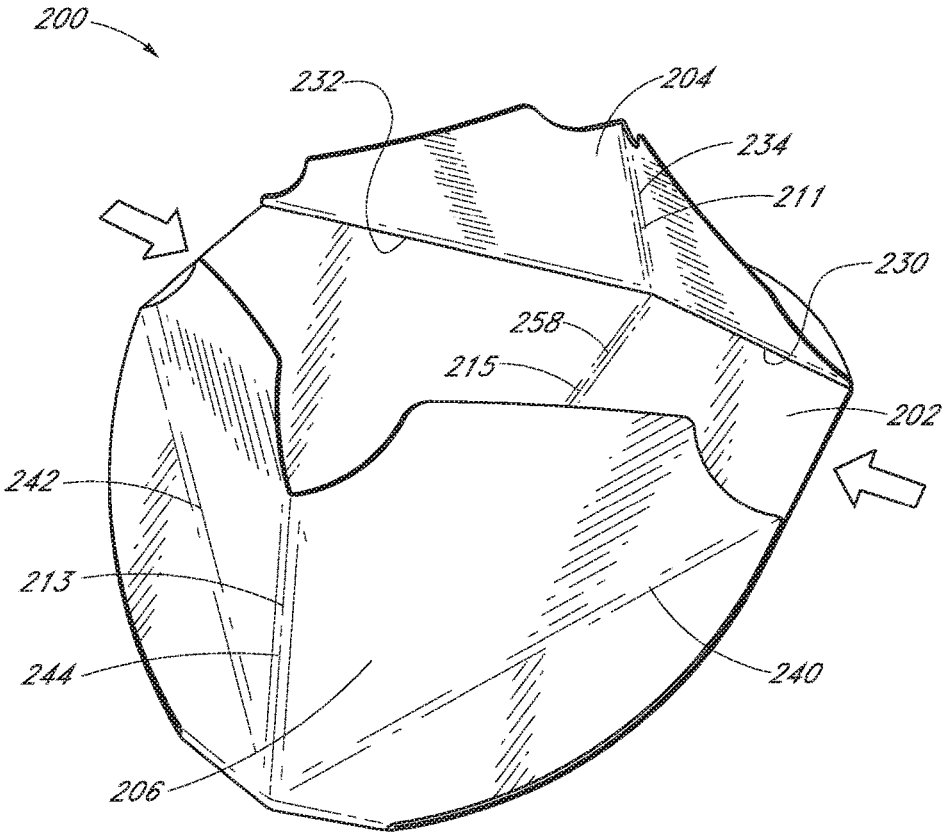
FIG. 18 shows the embodiment of the cover member of FIG. 12 in an open stat or configuration.
Figure 19:
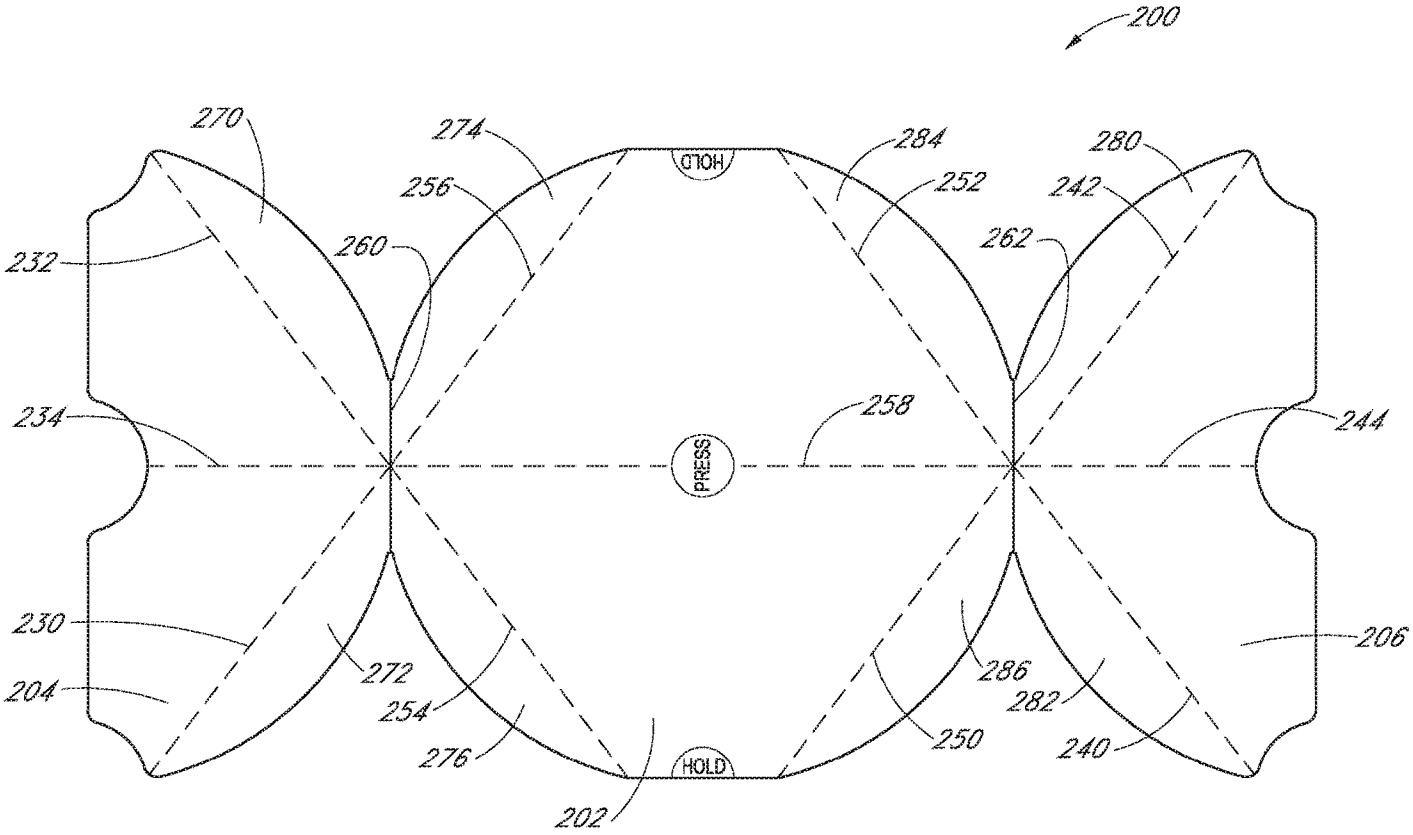
FIG. 19 is a bottom view of an embodiment of the cover member of FIG. 12 in an unfolded, prefinished state.
Figure 20:
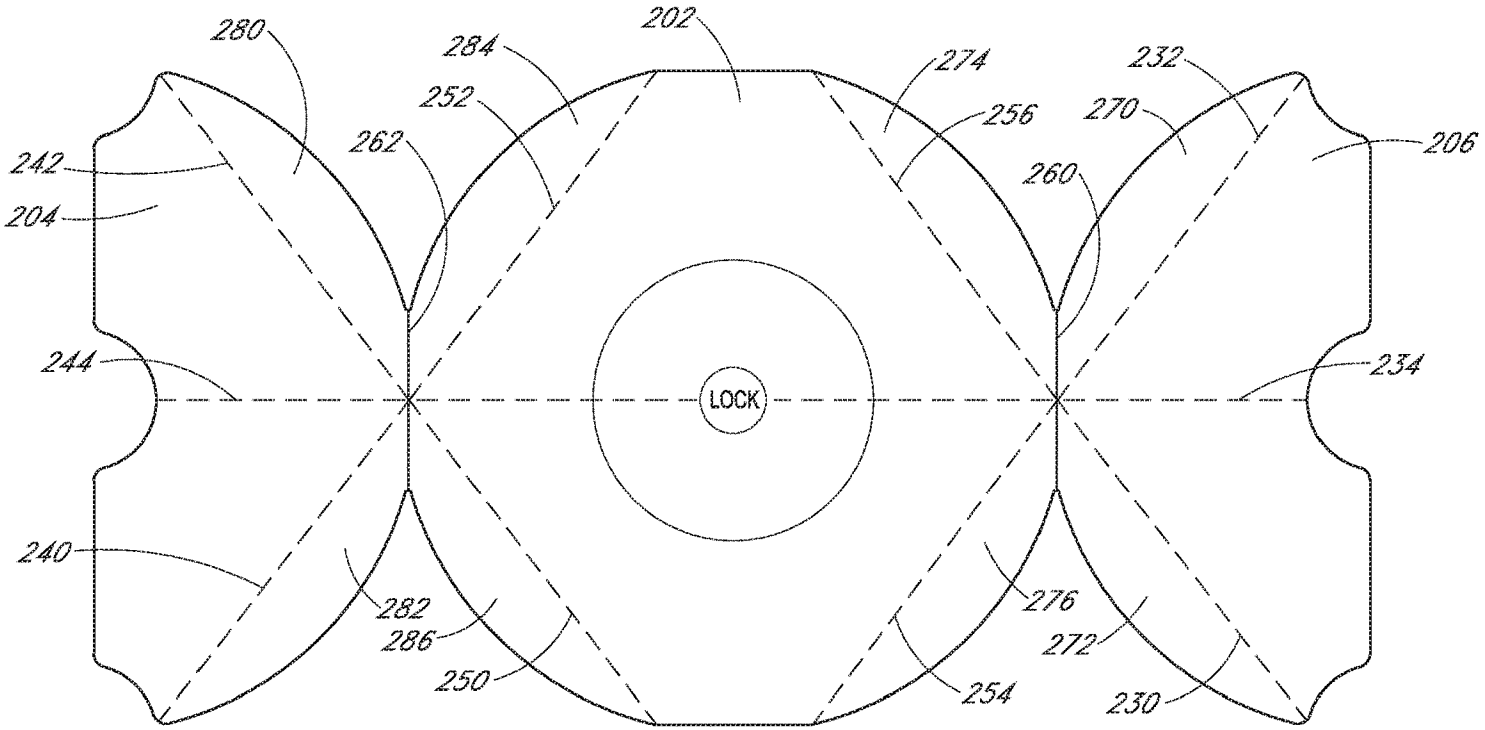
FIG. 20 is a top view of an embodiment of the cover member of FIG. 12 in an unfolded, prefinished state.

FIG. 18 illustrates the cover 200 in the second or open state, wherein the first flap portion 204 and the second flap portion 206 are each in an open position and ready to be applied over the top of a drinking container or glass. FIG. 19 is a top view of a flat pattern of the embodiment of the cover member 200 illustrated in FIG. 12, having the main body portion 202, the first flap portion 204, and the second flap portion 206. In any embodiments disclosed herein, the main body portion 202, the first flap portion 204, and the second flap portion 206 can be formed from a single, continuous and/or monolithic substrate. The substrate can be paper, as discussed above. For example, as shown in FIG. 19, the first flap portion 204 can be connected directly to or coupled directly with the main body portion 202. A fold 260 can be formed between the first flap portion 204 and the main body portion 202 so that the first flap portion 204 can fold over and cover a portion of the main body portion 202. Similarly, the second flap portion 206 can be connected directly to or coupled directly with the main body portion 202. A fold 262 can be formed between the second flap portion 206 and the main body portion 202 so that the second flap portion 206 can fold over and cover a portion of the main body portion 202. However, the cover member 200 is not required to be formed from a single, monolithic substrate but can be formed from multiple pieces coupled together.

The first flap portion 204 and the second flap portion 206 can be folded over so as to be adjacent to the main body portion 202. A portion of the first flap portion 204 and a portion of the second flap portion 206 can be bonded to a portion of the main body portion to hold the adjacent portions of the flap portions and the main body portion together. For example, with reference to FIG. 19, the first bonding portion 270 the of the first flap portion 204 can be bonded to the first bonding portion 274 of the main body portion. Similarly, the second bonding portion 272 of the first flap portion 204 can be bonded to the second bonding portion 276 of the main body portion. The first bonding portion 280 the of the second flap portion 206 can be bonded to the third bonding portion 284 of the main body portion. Similarly, the second bonding portion 282 of the first flap portion 204 can be bonded to the fourth bonding portion 286 of the main body portion.

The first bonding portion 270 of the first flap portion can be bounded by the crease 232, the folds 260, and an outer, peripheral edge of the first flap portion. The second bonding portion 272 of the first flap portion 204 can be bounded by the crease 230, the folds 260, and an outer, peripheral edge of the first flap portion 204. Similarly, the first bonding portion 274 of the main body portion can be bounded by the crease 256, the fold 260, and an outer, peripheral edge of the main body portion. The second bonding portion 276 of the main body portion 202 can be bounded by the crease 254, the fold 260, and an outer peripheral edge of the main body portion 202.

Similarly, the first bonding portion 280 of the second flap portion 206 can be bounded by the crease 242, the second fold 262, and an outer peripheral edge of the second flap portion. The second bonding portion 282 of the second flap portion 206 can be bounded by the crease 240, the second fold 262, and an outer, peripheral edge of the second flap portion. Any of the bonding portions can be bonded together by any suitable adhesive.

When the cover is in the second state, as illustrated in FIG. 18, a ridge can be formed in each of the first flap portion 204 and the second flap portion 206, wherein the peak or the apex of the ridge formed in the first flap portion 204 extends along the third crease 234 of the first flap portion 204. In this state or configuration, as illustrated, the first flap portion 204 can extend away from the main body portion 202. The first flap portion 204 can bend about the first and second creases 230, 232 of the first flap portion so that the first and second creases 230, 232 remain adjacent to the main body portion 202 and remain adjacent to the base of the ridge.

Similarly, the second flap portion 206 can extend away from the main body portion 202. The second flap portion 206 can bend about the first and second creases 240, 242 of the second flap portion 206 so that the first and second creases 240, 242 remain adjacent to the main body portion 202 and remain adjacent to the base of the ridge. Additionally, any embodiments of the cover can be configured such that, in this second state of the cover, a ridge can be formed in the main body portion along the crease 258 such that the portion of the main body portion 202 along the crease forms the apex of the ridge. The creases 250, 252, 254, and 256 formed in the main body portion can remain at the base of the ridge and remain adjacent to portions of the first flap portion and the second flap portion, in particular, adjacent to the creases 230, 232 of the first flap portion and the creases 240, 242 of the second flap portion 206.

Figure 21:
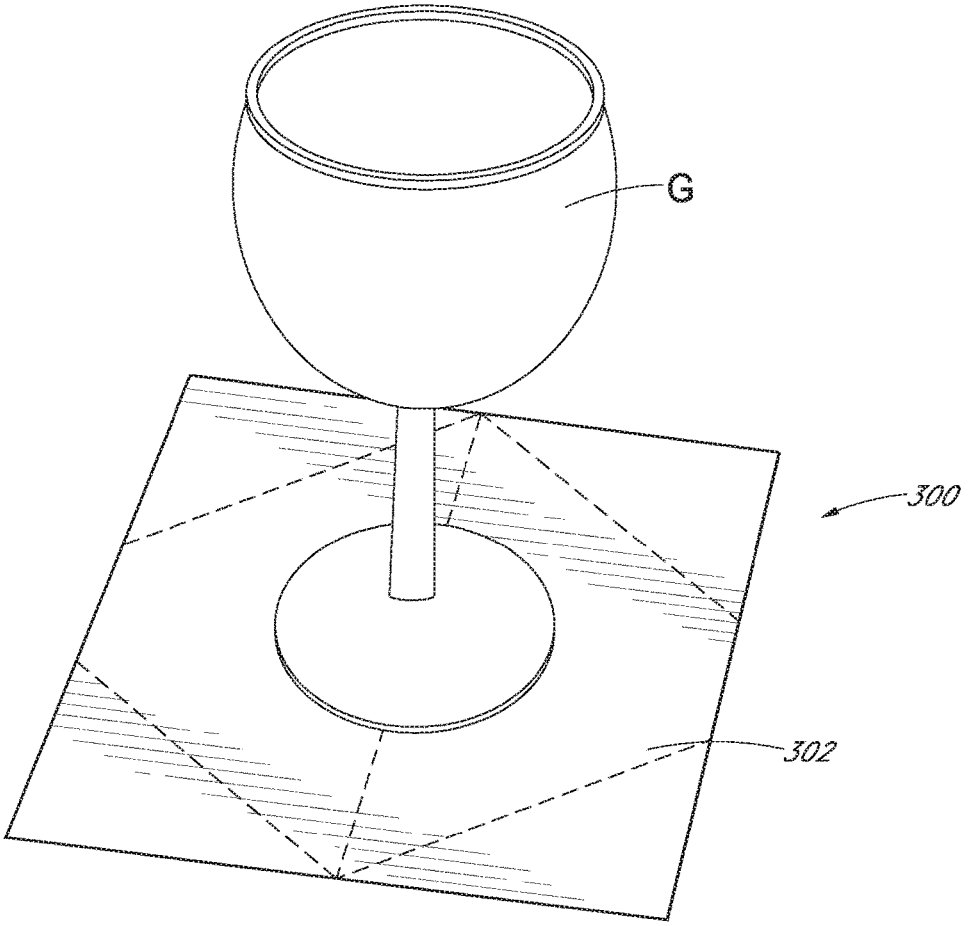
FIG. 21 shows another embodiment of a cover member that can be used to cover a drinking container from unwanted contamination, showing the cover member in a first or planar state.
Figure 22:
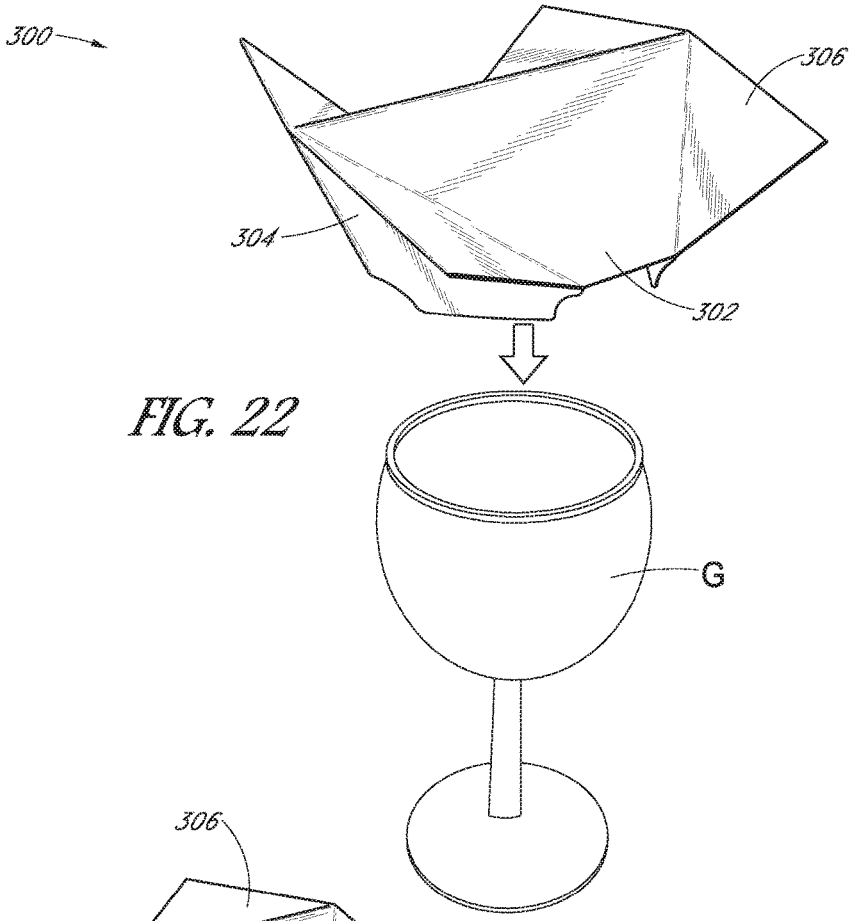
FIG. 22 shows the embodiment of the cover member of FIG. 21 in a second state or open configuration wherein the cover member is in a nonplanar state and in which the cover member can be positioned over the top of a glass.
Figure 23:
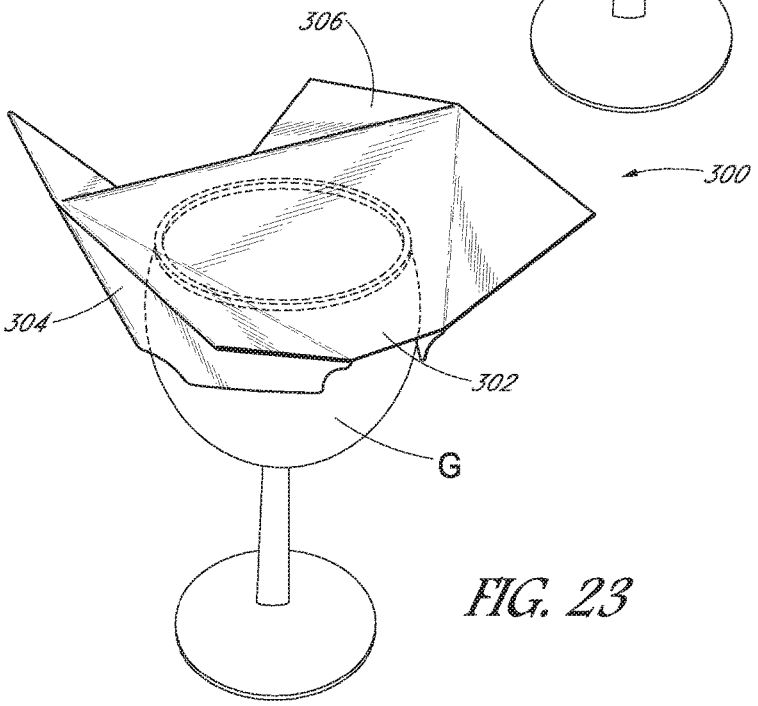
FIG. 23 shows the embodiment of the cover member of FIG. 21 positioned over the opening of the glass G so as to cover the opening of the glass to prevent unwanted contamination from entering the glass without removing or lifting the cover from the glass.
Figure 24:
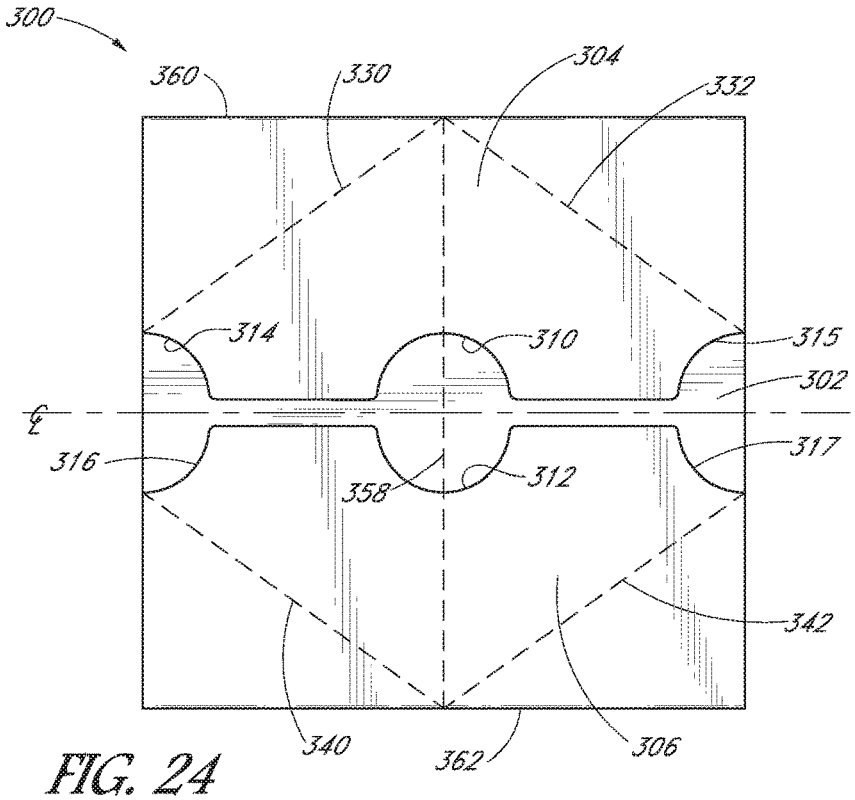
FIG. 24 is a bottom view of the embodiment of the cover member of FIG. 21, showing the bottom side of the cover member.
Figure 25:
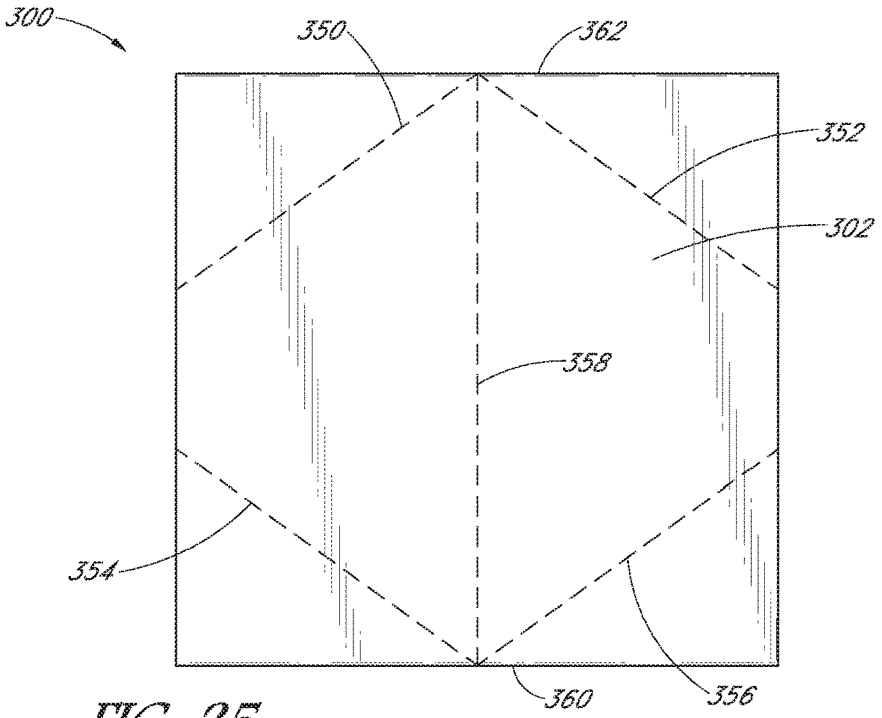
FIG. 25 is a top view of the embodiment of the cover member of FIG. 21, showing the top side of the cover member.
Figure 26:
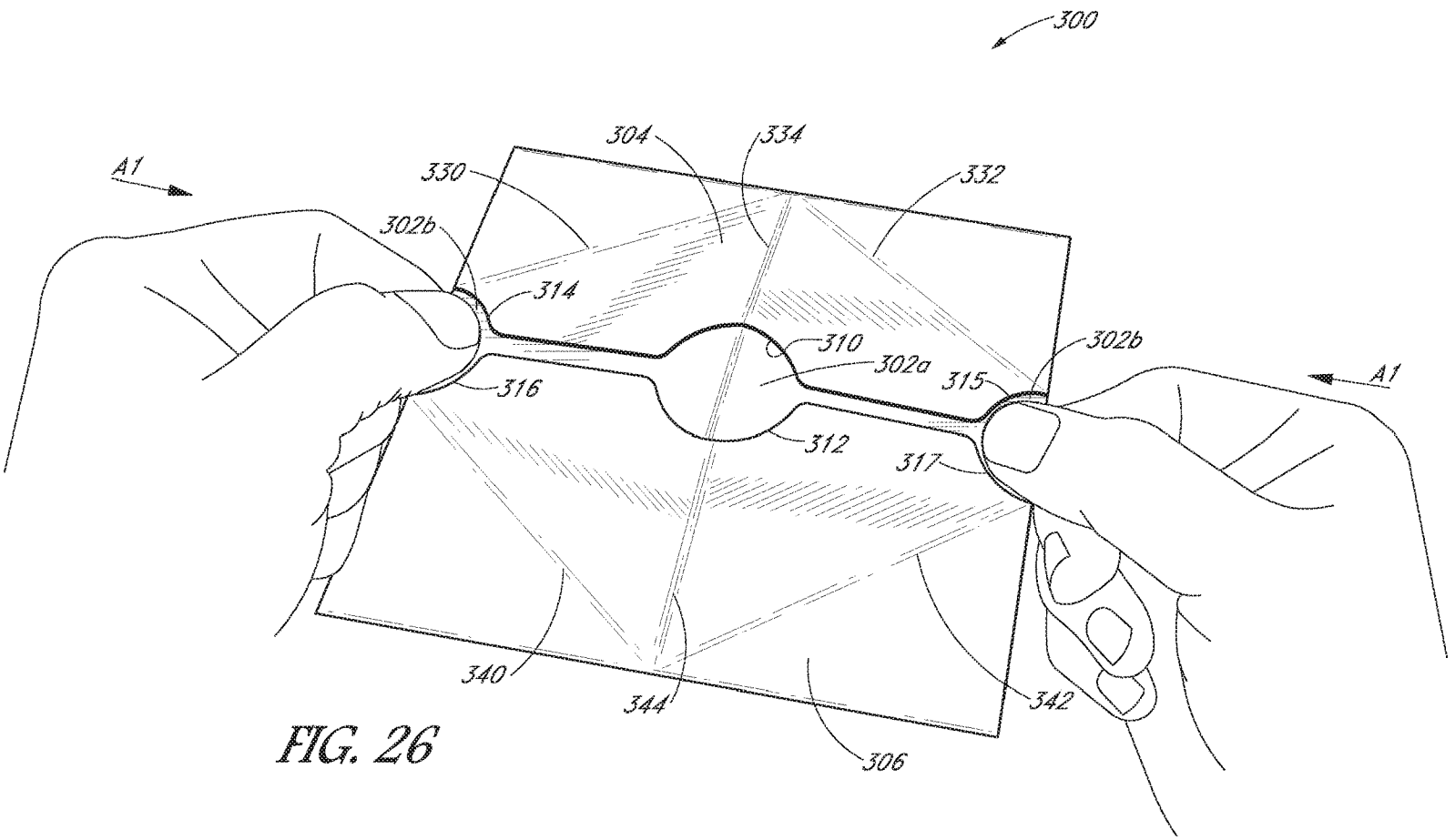
FIG. 26 shows the embodiment of the cover member of FIG. 21 being grasped and manipulated by a user's hands.

FIG. 21 shows another embodiment of a cover member 300 that can be used to cover a drinking container from unwanted contamination, showing the cover member in a first or planar state. FIG. 22 shows the embodiment of the cover member of FIG. 21 in a second state or open configuration wherein the cover member is in a nonplanar state and in which the cover member can be positioned over the top of a glass. FIG. 23 shows the embodiment of the cover member 300 positioned over the opening of the glass G so as to cover the opening of the glass to prevent unwanted contamination from entering the glass without removing or lifting the cover from the glass. FIGS. 24 and 25 are a bottom view and a top view, respectively, of the embodiment of the cover member 300, showing the bottom side and top side of the cover member, respectively. FIG. 26 shows the embodiment of the cover member 300 being grasped and manipulated by a user's hands.

The cover member 300 can have any of the same features, shapes, components, materials, markings, indentations, and/or any of the other details of any of the other embodiments disclosed herein. Additionally, any of the other cover member embodiments disclosed herein can have any of the same features, shapes, components, materials, markings, indentations, and/or any of the other details related to any of the embodiments of the cover member 300 disclosed herein. For example and without limitation, any of the embodiments of the cover member 300 disclosed herein can have any of the same features, materials, and other details of the embodiment of the cover member 200 except that the shape of an outer profile or outer perimeter of the cover member 300 can be generally square. In any embodiments disclosed herein, the outer profile or outer perimeter of the cover member can be any desired shape, such as circular, circular with flat side portions, square, hexagonal, octagonal, or other polygonal shapes, or any other desired shape and/or size.

The cover member 300 can be approximately 4.5 inches across when the cover member is in the first, or planar state or configuration. Additionally, the cover member 300 can be sized so that the cover member is from approximately 4 inches or less to approximately 6 inches or more across, or from approximately 4.5 inches or less to approximately 5.5 inches or more across, when the cover member is in the first, or planar state or configuration.

The cover member 300 can have a main body portion 302, a first flap portion 304, and a second flap portion 306. In any embodiments, the first flap portion 304 can have a first crease 330, a second crease 332, and a third crease 334 formed in the first flap portion. With reference to FIG. 15, the third crease 334 can be formed along a centerline of the first flap portion 304 in a direction A2 that is approximately perpendicular to the direction A1. The third crease 334 can be formed along the entire length of the first flap portion in the direction A2. The first crease 330 can be formed at an angle X1 relative to the direction of the third crease 334. In any embodiments disclosed herein, the first crease 330 can be formed at an angle that is approximately 52.5 degrees relative to the third crease 334, or from approximately 45 degrees to approximately 60 degrees, or from approximately 50 degrees to approximately 55 degrees relative to the third crease 334, or from or to any values within this range, depending on the size and geometry of the first flap portion.

Additionally, the first flap portion 304 can have a first cutout 310 and the second flap portion 306 can have a first cutout 312 positioned near the center of the cover member to permit a user to have access to a center portion 302*a* of the main body portion 302 of the cover member. In any embodiments disclosed herein, for example, the cover member may be changed from the first state or position to the second state or position by exerting a force against the center portion 302*a* of the main body portion 302 to deflect the center portion 302*a* of the main body portion 302. In some embodiments, the user can also spread the first flap portion 304 away from the second flap portion 306 to move the flap portions from the first position to the second position, respectively, so as to change the cover member from the first state to the second state. Or, in some embodiments, both of these steps can be done at the same time.

In any embodiments disclosed herein, the first flap portion 304 can have a second cutout 314 and a third cutout 315, and the second flap portion 306 can have a second cutout 316 and a third cutout 317 positioned near the lateral edges of the flap portions to permit access by the user to the lateral edge portions 302*b* of the main body portion 302. With reference to FIG. 26, the user can grasp the cover member 300 by grasping the lateral edge portions 302*b* of the main body portion 302 and exert an inward force (i.e., in the inward direction A1 as shown in FIG. 26) to deflect the first and second flap portions 304, 306 outwardly and, therefore, to change the cover member from the first state to the second state. To change the cover member from the second state to the first state, the user can grasp the lateral edge portions 302*b* of the main body portion 302 and exert an outward force (i.e., in the opposite direction as direction A1) to deflect the first and second flap portions 304, 306 inwardly.

In any of the cover member embodiments disclosed herein, including without limitation the cover member embodiment 200 and/or the cover member embodiment 300, any of the bend lines or creases can be creases, folds, perforations, score lines, or any similar features configured to aid the cover member or portions thereof to bend or fold about such creases or lines, or any combination of the foregoing.

Any embodiments of the protective covers disclosed herein can be housed in and provided to patrons from a dispenser that can house or support multiple drink covers. In some embodiments, the dispenser can be configured similar to a napkin dispenser or holder. In some embodiments, the cup covers can be formed in series such as in a long roll with perforations or separations between each of the cup covers so that a user can withdraw the desired number of cup covers from the roll.

Any of the embodiments disclosed herein of the assemblies, components, or parts can have any combination of the features, components, or other details of any of the other assemblies, components, or parts disclosed herein or known in the field of reformer devices or other exercise apparatuses. Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

While certain embodiments have been described, these embodiments have been presented by way of example only, and are not intended to limit the scope of protection. Indeed, the novel methods and systems described herein may be embodied in a variety of other forms. Furthermore, various omissions, substitutions and changes in the form of the methods and systems described herein may be made. Those skilled in the art will appreciate that in some embodiments, the actual steps taken in the processes illustrated and/or disclosed may differ from those shown in the Figures. Depending on the embodiment, certain of the steps described above may be removed, others may be added. Accordingly, the scope of the present disclosure is intended to be defined only by reference to the appended claims. The accompanying claims and their equivalents are intended to cover such forms or modifications as would fall within the scope and spirit of the protection. Furthermore, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims or claims that will be added in the future.

Features, materials, characteristics, or groups described in conjunction with a particular aspect, embodiment, or example are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Accordingly, while certain embodiments have been described, these embodiments have been presented by way of example only, and are not intended to limit the scope of protection. Indeed, the novel methods and systems described herein may be embodied in a variety of other forms. Furthermore, various omissions, substitutions and changes in the form of the methods and systems described herein may be made. Those skilled in the art will appreciate that in some embodiments, the actual steps taken in the processes illustrated and/or disclosed may differ from those shown in the Figures. Depending on the embodiment, certain of the steps described above may be removed, others may be added. Furthermore, the features and attributes of the specific embodiments disclosed above may be combined in different ways to form additional embodiments, all of which fall within the scope of the present disclosure.

Although the present disclosure includes certain embodiments, examples and applications, it will be understood by those skilled in the art that the present disclosure extends beyond the specifically disclosed embodiments to other alternative embodiments and/or uses and obvious modifications and equivalents thereof, including embodiments which do not provide all of the features and advantages set forth herein. Accordingly, the scope of the present disclosure is not intended to be limited by the specific disclosures of preferred embodiments herein, and may be defined by claims as presented herein or as presented in the future. Finally, as used herein and unless otherwise stated, the term approximately is meant to represent a range of +/−10% of the stated value.

Although the embodiments of the inventions have been disclosed in the context of a certain preferred embodiments and examples, it will be understood by those skilled in the art that the present embodiments and inventions extend beyond the specifically disclosed embodiments to other alternative embodiments and/or uses of the inventions and obvious modifications and equivalents thereof. In addition, while a number of variations of the embodiments and inventions have been shown and described in detail, other modifications, which are within the scope of the inventions, will be readily apparent to those of skill in the art based upon this disclosure. Other sizes, shapes, features, and configurations of any of the components disclosed herein can be used with any of the other sizes, shapes, features, and configurations disclosed herein to form additional embodiments that may not have been explicitly described herein. All such embodiments form part of the present disclosure.

Accordingly, it should be understood that various features and aspects of the disclosed embodiments can be combined with or substituted for one another in order to form varying modes of the disclosed inventions. Thus, it can be intended that the scope of the present inventions herein disclosed should not be limited by the particular disclosed embodiments described above.

What is claimed is:

1. A cover configured to protect the contents of a drinking container from unwanted contamination, comprising:

a body portion having a first surface and a second surface, the second surface opposing the first surface;

a first flap portion coupled with the body portion;

a first preformed crease formed in the first flap portion at a base of the first flap portion where the first flap portion is connected to the body portion;

a second flap portion coupled with the body portion; and a second preformed crease formed in the second flap portion at a base of the second flap portion where the second flap portion is connected to the body portion;

wherein:

the body portion has an outer perimeter that is configured to be at least as big as an outer perimeter of a rim of a drinking container;

the cover is configured such that the first flap portion is movable relative to the body portion from a first position in which the first flap portion is generally parallel with and adjacent to the second surface of the body portion to a second position in which the first flap portion extends at an angle away from the second surface of the body portion;

the cover is configured such that the second flap portion is movable relative to the body portion from a first position in which the second flap portion is generally parallel with and adjacent to the second surface of the body portion to a second position in which the second flap portion extends at an angle away from the second surface of the body portion;

the cover is configured to bias the first and second flap portions to bend about the first and second preformed creases when the first and second flap portions are moved from the first position to the second position; and when the first and second flap portions are moved to the second position, the first and second flap portions are configured to surround at least a portion of an outside surface of a drinking container adjacent to the opening and to prevent the cover from sliding off of the drinking container.

2. The cover of claim 1, wherein the cover member is configured such that moving the first flap portion from the first position to the second position will cause the body portion to be changed from a generally planar state to a generally nonplanar state.

3. The cover of claim 1, wherein the body portion, the first flap portion, and the second flap portion are each made entirely from one or more substantially non-stretchable materials.

4. The cover of claim 1, wherein: when the first and second flap portions are in the second position:

the cover is configured to be positionable over an opening of a drinking container such that the second surface is configured to be positionable against a rim of the drinking container;

the first flap portion and the second flap portion are configured to at least partially surround an outside surface of a drinking container adjacent to the rim of a drinking container; and the body portion of the cover is configured to completely cover the opening of the drinking container.

5. The cover of claim 1, wherein, when the first and second flap portions are in the first position, the cover is generally planar.

6. The cover of claim 1, wherein the cover member is configured such that moving the first flap portion from the first position to the second position will cause a first ridge to be formed in a lengthwise direction along at least a portion of a length of the first flap portion and moving the second flap portion from the first position to the second position will cause a second ridge to be formed in a lengthwise direction along at least a portion of a length of the second flap portion.

7. The cover of claim 1, wherein the cover member is configured such that moving the first flap portion from the first position to the second position and moving the second flap portion from the first position to the second position will cause at least one ridge to be formed in the first flap portion, at least one ridge to be formed in the second flap portion, and at least one ridge to be formed in the middle portion.

8. The cover of claim 1, wherein the cover is configured such that, moving a first portion of the body portion toward a second portion of the body portion causes the first flap member to move from the first position toward the second position and the second flap member to move from the first position toward the second position, respectively.

9. The cover of claim 1, wherein the cover is configured such that, moving a first edge of the body portion in a first direction toward a second edge of the body portion causes the first flap member to move in a second direction from the first position to the second position and causes the second flap member to move in a third direction from the first position to the second position, the second and third directions being generally orthogonal to the first direction, and the third direction being generally opposite to the second direction.

10. The cover of claim 1, wherein the first and second flap portions are configured to collectively surround the majority of the circumference of a rim of a drinking container when the first and second flap portions are in the second position.

11. A method of protecting a drinking container from outside contamination by covering an opening of a drinking container with the cover of claim 1, comprising:

moving the first flap portion from the first position to the second position and moving the second flap portion from the first position to the second position by moving a first side of the middle portion of the cover toward a second side of the middle portion; and positioning the cover over the rim of a drinking container.

12. The method of protecting a drinking container from outside contamination of claim 11, wherein moving the first flap portion from the first position to the second position and moving the second flap portion from the first position to the second position comprises squeezing the sides of the cover to cause the first and second flaps to bend away from the body portion of the cover.

13. A cover for a drinking container, comprising:

a middle portion having a first surface and a second surface, the second surface opposing the first surface;

a first flap coupled with the middle portion; and a second flap coupled with the middle portion;

wherein:

the middle portion has an outer perimeter that is configured to be at least as big as an outer perimeter of a rim of a drinking container;

the first flap is movable relative to the second surface of the middle portion from a first position in which the first flap is generally parallel with and adjacent to the second surface of the middle portion so as to overlap at least a portion of the second surface of the middle portion to a second position in which the first flap extends at an angle away from the second surface of the middle portion sufficient to place the cover over the rim of the drinking container such that a distal end portion of the first flap is outside of an outside surface of the drink container;

the second flap is movable relative to the second surface of the middle portion from a first position in which the second flap is generally parallel with and adjacent to the second surface of the middle portion so as to overlap at least a portion of the second surface of the middle portion to a second position in which the second flap extends at an angle away from the second surface of the middle portion sufficient to place the cover over the rim of the drinking container such that a distal end portion of the second flap is outside of an outside surface of the drink container; and the cover is configured such that:

when the first and second flaps are in the second position, the first and second flaps are configured to surround at least a portion of an outside surface of a drinking container adjacent to the opening and to prevent the cover from sliding off of the drinking container;

when the first and second flaps are in the second position, the first and second flap portions are each biased to move toward the first position; and moving a first side of the middle portion of the cover toward a second side of the middle portion of the cover simultaneously moves the first flap member from the first position toward the second position and moves the second flap member from the first position toward the second position.

14. The cover of claim 13, wherein the cover member is configured such that moving the first flap from the first position to the second position will cause a ridge to be formed in the first flap.

15. The cover of claim 13, wherein the cover member is configured such that moving the first flap from the first position to the second position will cause the first flap to be changed from a planar state to a corrugated state.

16. The cover of claim 13, wherein the middle portion, the first flap, and the second flap are each made entirely from one or more substantially non-stretchable materials.

17. The cover of claim 13, wherein the cover is configured to cover and secure itself around a rim of a drinking container without substantially stretching any portion of the cover.

18. The cover of claim 13, wherein the middle portion has a first crease extending entirely across the middle portion along a centerline of the middle portion, the middle portion being biased to bend about the first crease of the middle portion when the first and second flaps are moved from the first position to the second position.

19. A cover for preventing an unwanted substance from entering a drinking container, comprising:

a main cover portion having a first surface and a second surface, the second surface opposing the first surface; and a first flap coupled with the main cover portion near a first edge of the main cover portion;

a first crease formed in the first flap;

a second crease formed in the first flap, the second crease intersecting the first crease in the first flap; and a second flap coupled with the main cover portion near a second edge of the main cover portion;

wherein:

the first flap is rotatable relative to the second surface of the main cover portion from a first position in which the first flap is generally parallel with and overlapping the second surface of the main cover portion to a second position in which the first flap extends at an angle away from the second surface of the main cover portion;

the second flap is rotatable relative to the second surface of the main cover portion from a second position in which the second flap is generally parallel with and overlapping the second surface of the main cover portion to a second position in which the second flap extends at an angle away from the second surface of the main cover portion;

the first crease formed in the first flap is configured to bias the first flap to bend about the first crease when the first flap is rotated from the first position to the second position;

the cover is configured such that, when the first flap is in the first position, a portion of the first flap that overlaps the second surface of the main cover portion is generally planar;

the cover is configured such that, when the first flap is rotated toward the second position, the first flap is biased to bend about the second crease such that a portion of the first flap that extends away from the second surface of the main cover portion will change to a generally nonplanar state; and when the first flap is rotated to the second position, the first flap is configured to surround at least a portion of an outside surface of a drinking container adjacent to the opening so as to secure the cover to a drinking container to cover the opening of a drinking container.

20. The cover of claim 19 wherein the cover has only two flap portions, the first flap portion and the second flap portion.

21. A cover for a drinking container, comprising:

a middle portion having a first surface and a second surface, the second surface opposing the first surface;

a first flap coupled with the middle portion; and a second flap coupled with the middle portion;

wherein:

the middle portion has an outer perimeter that is configured to be at least as big as an outer perimeter of a rim of a drinking container;

the first flap is movable relative to the second surface of the middle portion from a first position in which the first flap is generally parallel with and adjacent to the second surface of the middle portion so as to overlap at least a portion of the second surface of the middle portion to a second position in which the first flap extends at an angle away from the second surface of the middle portion sufficient to place the cover over the rim of the drinking container such that a distal end portion of the first flap is outside of an outside surface of the drink container;

the second flap is movable relative to the second surface of the middle portion from a first position in which the second flap is generally parallel with and adjacent to the second surface of the middle portion so as to overlap at least a portion of the second surface of the middle portion to a second position in which the second flap extends at an angle away from the second surface of the middle portion sufficient to place the cover over the rim of the drinking container such that a distal end portion of the second flap is outside of an outside surface of the drink container;

wherein the middle portion has a first crease extending entirely across the middle portion along a centerline of the middle portion, the middle portion being biased to bend about the first crease of the middle portion when the first and second flaps are moved from the first position to the second position;

the cover is configured such that, when the first and second flaps are in the second position, the first and second flaps are configured to surround at least a portion of an outside surface of a drinking container adjacent to the opening and to prevent the cover from sliding off of the drinking container; and the cover is configured such that, when the first and second flaps are in the second position, the first and second flap portions are each biased to move toward the first position.

* * * * *